US005224897A

United States Patent [19]

Linden et al.

[11] Patent Number: 5,224,897

[45] Date of Patent: Jul. 6, 1993

[54] SELF-REPLICATING DUPLEX FORMS

[76] Inventors: Gerald E. Linden, 11 Vincent Dr., Monroe, Conn. 06468; Keith E. Schubert, 4 Timothy Rd., W. Norwalk, Conn. 06850

[21] Appl. No.: 908,540

[22] Filed: Jun. 29, 1992

Related U.S. Application Data

[63] Continuation of Ser. No. 591,781, Oct. 2, 1990, abandoned, which is a continuation-in-part of Ser. No. 497,219, Mar. 22, 1990, Pat. No. 5,154,668, which is a continuation-in-part of Ser. No. 494,565, Mar. 16, 1990, Pat. No. 5,137,494, which is a continuation-in-part of Ser. No. 484,686, Feb. 23, 1990, abandoned, which is a continuation-in-part of Ser. No. 436,189, Nov. 13, 1989, Pat. No. 5,197,922, which is a continuation-in-part of Ser. No. 334,183, Apr. 6, 1989, Pat. No. 5,127,879.

[51] Int. Cl.[5] ..... B41L 1/20

[52] U.S. Cl. ..... 462/24; 462/66; 462/68; 462/84

[58] Field of Search ..... 283/116; 503/205, 226; 462/25, 7, 9, 17, 53, 56, 57, 66, 67, 68, 84

[56] References Cited

U.S. PATENT DOCUMENTS

| | | | |
|---|---|---|---|
| Re. 30,041 | 7/1979 | Maalouf | 282/27.5 |
| Re. 30,116 | 10/1979 | Maalouf | 282/27.5 |
| Re. 31,695 | 10/1984 | Zink | 427/211 |
| 371,126 | 10/1887 | Currie . | |
| 396,560 | 1/1889 | Harrison et al. . | |
| 418,455 | 12/1889 | Gray . | |

(List continued on next page.)

FOREIGN PATENT DOCUMENTS

| | | |
|---|---|---|
| 549442 | 4/1932 | Fed. Rep. of Germany . |
| 613658 | 3/1926 | France . |
| 128558 | 2/1962 | New Zealand . |
| 128915 | 3/1964 | New Zealand . |
| 185282 | 11/1980 | New Zealand . |
| 1347807 | 2/1974 | United Kingdom . |
| 2085359 | 4/1982 | United Kingdom . |

OTHER PUBLICATIONS

Black Clawson Brochure.

"Flip-N-Rite", 7-page instructions by Gary Thompson.

FORM Magazine, Feb., 1989, pp. 74–80.

Business Forms Labels & Systems, Jul. 1990, p. 48.

"Pressure Sensitive Papers", Project 2558, No. 222, TAPPI Coating Committee, 1965.

"Pressure Sensitive Papers", Project 2558, TAPPI Coating Committee, Dec. 1967.

Facsimiles of BH Medical, MAP Phone Message, Moore Two-Way Rite, St. Vincent Medical Center, Maybelline and Hartz Mountain forms.

*Primary Examiner*—Paul A. Bell

*Attorney, Agent, or Firm*—Gerald E. Linden

[57] ABSTRACT

Improvements to self-replicating duplex forms are disclosed. Generally, a single sheet of paper is divided into original and copy panels by fold line, and carbonless coatings are applied to the panels so that information entered on the two, front and back surfaces of the original panel are reproduced on the two surfaces of the copy panel.

(Group 1) An endorsable carbonless CB coating is applied to the original panel, either at the mill or on-press. A carbonless CF coating is applied to the copy panel so that the coated copy panel is substantially the same thickness as the coated original panel. Specific areas for filling out information on the original panel are offset, from front-to-back, and methods of checking this offset are disclosed. The copy panel is tinted a dissimilar base color from the original panel.

(Group 2) The original and copy panels can be formed separately, and joined into a single "virtual" sheet.

(Group 3) The original and copy panels can be formed of a single sheet of CF C2S paper stock. A separate, intermediate transfer panel having a CB-coated surface is interposed between the original and copy panels to effect two-sided reproduction.

(Group 4) The form can be of laminated construction of off-the-shelf carbonless paper stock to obtain the coating arrangements of the various configurations.

14 Claims, 13 Drawing Sheets

| | | | |
|---|---|---|---|
| 419,359 | 1/1890 | Rogers . | |
| 445,368 | 1/1891 | Campbell . | |
| 664,384 | 12/1900 | Cooke . | |
| 683,782 | 10/1901 | Morland . | |
| 756,258 | 4/1904 | Mallin . | |
| 765,408 | 7/1904 | Wildey . | |
| 797,302 | 8/1905 | Meacham . | |
| 897,783 | 9/1908 | Reynolds . | |
| 971,283 | 9/1910 | Krueger . | |
| 972,549 | 10/1910 | Lewis . | |
| 1,101,262 | 6/1914 | Edmonds . | |
| 1,187,682 | 6/1916 | Trueman | 282/12 |
| 1,301,834 | 4/1919 | Gilman . | |
| 1,392,748 | 10/1921 | Davidson . | |
| 1,468,094 | 9/1923 | Wherry . | |
| 1,873,997 | 8/1932 | Davis . | |
| 1,980,318 | 11/1934 | Caton . | |
| 1,980,319 | 11/1934 | Caton . | |
| 2,006,034 | 6/1935 | Stevens . | |
| 2,035,768 | 3/1936 | Sherman et al. | 91/68 |
| 2,084,221 | 6/1937 | Schutz . | |
| 2,093,086 | 9/1937 | Luzzatto | 282/27 |
| 2,098,706 | 11/1937 | Lawson et al. | 282/12 |
| 2,118,888 | 5/1938 | Lewis et al. | 101/131 |
| 2,131,381 | 9/1938 | Linderman | 282/28 |
| 2,148,886 | 2/1939 | Wanser | 229/69 |
| 2,168,098 | 8/1939 | Groák | 282/26 |
| 2,194,670 | 3/1940 | Neu | 282/27 |
| 2,211,532 | 8/1940 | Biggs | 282/12 |
| 2,220,842 | 11/1940 | Hano | 282/12 |
| 2,226,722 | 12/1940 | Jones | 282/22 |
| 2,257,766 | 10/1941 | Sherman | 282/3 |
| 2,262,347 | 11/1941 | Sturc | 282/26 |
| 2,264,119 | 11/1941 | Lichter | 283/1 |
| 2,327,215 | 8/1943 | Potter | 282/12 |
| 2,458,729 | 1/1949 | Politzer | 40/102 |
| 2,470,586 | 5/1949 | Tathwell | 282/9 |
| 2,503,680 | 4/1950 | Newman | 282/19 |
| 2,548,366 | 4/1951 | Green et al. | 282/28 |
| 2,550,466 | 4/1951 | Green et al. | 282/28 |
| 2,550,468 | 4/1951 | Green et al. | 282/28 |
| 2,550,469 | 4/1951 | Green et al. | 282/28 |
| 2,606,775 | 8/1952 | Newman | 282/28 |
| 2,618,573 | 11/1952 | Green | 117/36 |
| 2,637,571 | 5/1953 | Tilly | 281/5 |
| 2,694,429 | 11/1954 | Berger | 150/39 |
| 2,712,507 | 7/1955 | Green | 117/36 |
| 2,802,678 | 8/1957 | Bright | 282/22 |
| 2,869,898 | 1/1959 | Martin . | |
| 2,870,040 | 1/1959 | Gill | 117/36 |
| 2,907,585 | 10/1959 | Sornberger | 282/22 |
| 2,980,447 | 4/1961 | Weger | 282/22 |
| 3,016,308 | 1/1962 | Macaulay | 117/36.7 |
| 3,104,799 | 9/1963 | Steidinger | 229/69 |
| 3,364,052 | 1/1968 | Martino | 117/15 |
| 3,376,154 | 4/1968 | Campbell et al. | 117/364 |
| 3,429,827 | 2/1969 | Ruus | 252/316 |
| 3,481,759 | 12/1969 | Ostlie | 117/36.2 |
| 3,539,375 | 11/1970 | Baum | 117/36.2 |
| 3,625,547 | 12/1971 | Burke | 282/23 |
| 3,682,681 | 8/1972 | Kunkel | 117/36.2 |
| 3,769,057 | 10/1973 | Lin | 117/36.2 |
| 3,769,062 | 10/1973 | Ishige et al. | 117/36.2 |
| 3,825,467 | 7/1974 | Phillips, Jr. | 161/159 |
| 3,854,654 | 12/1974 | Van Malderghem | 229/69 |
| 3,902,655 | 9/1975 | Huffman | 229/69 |
| 3,908,063 | 9/1975 | Rosendale et al. | 428/320 |
| 3,945,870 | 3/1976 | Johnsen | 156/201 |
| 3,955,750 | 5/1976 | Huffman | 229/69 |
| 3,963,853 | 6/1976 | Hughes et al. | 428/326 |
| 3,968,299 | 7/1976 | Angleman | 428/307 |
| 3,981,523 | 9/1976 | Maalouf | 282/27.5 |
| 3,988,971 | 11/1976 | Steidinger | 93/63 M |
| 3,996,406 | 12/1976 | Alsop | 428/307 |
| 4,000,916 | 1/1977 | Lucas | 282/11.5 |
| 4,036,511 | 7/1977 | Maalouf | 282/27.5 |
| 4,039,046 | 7/1977 | D'Luhy | 282/22 R |
| 4,045,053 | 8/1977 | Carriere | 282/22 R |
| 4,046,404 | 9/1977 | Treier | 282/27.5 |
| 4,056,191 | 11/1977 | Weisenfluh | 206/629 |
| 4,062,567 | 12/1977 | Macaulay | 282/27.5 |
| 4,063,754 | 12/1977 | Shackle et al. | 282/27.5 |
| 4,081,127 | 3/1978 | Steidinger | 229/69 |
| 4,081,188 | 3/1978 | Westcott | 282/27.5 |
| 4,091,122 | 5/1978 | Davis et al. | 427/44 |
| 4,095,695 | 6/1978 | Steidinger | 206/620 |
| 4,097,619 | 6/1978 | Davis et al. | 427/44 |
| 4,111,461 | 9/1978 | Levensalor | 282/27.5 |
| 4,112,138 | 9/1978 | Davis et al. | 427/54 |
| 4,113,281 | 9/1978 | Halse | 282/11.5 A |

| | | | |
|---|---|---|---|
| 4,121,857 | 10/1978 | Halse | 282/11.5 A |
| 4,126,334 | 11/1978 | Van Malderghem | 282/22 R |
| 4,137,343 | 1/1979 | Davis et al. | 427/150 |
| 4,138,302 | 2/1979 | D'Luhy | 156/216 |
| 4,139,218 | 2/1979 | Davis et al. | 282/27.5 |
| 4,139,392 | 2/1979 | Davis et al. | 106/14.5 |
| 4,143,890 | 3/1979 | Davis et al. | 282/27.5 |
| 4,143,891 | 3/1979 | Neubauer | 282/27.5 |
| 4,165,101 | 8/1979 | Sternberg | 282/27.5 |
| 4,168,851 | 9/1979 | Halse | 282/11.5 A |
| 4,172,605 | 10/1979 | Welsch et al. | 282/27.5 |
| 4,178,018 | 12/1979 | Halse | 282/11.5 A |
| 4,198,446 | 4/1980 | Goetz | 427/150 |
| 4,199,174 | 4/1980 | Sornberger | 282/27.5 |
| 4,203,619 | 5/1980 | Sanders | 282/27.5 |
| 4,208,460 | 6/1980 | Knechtle et al. | 428/195 |
| 4,217,162 | 8/1980 | Glanz et al. | 156/305 |
| 4,282,275 | 8/1981 | Werner | 427/428 |
| 4,336,067 | 6/1982 | Shackle et al. | 106/21 |
| 4,343,494 | 8/1982 | Ehrhardt et al. | 282/27.5 |
| 4,352,855 | 10/1982 | Hiraishi et al. | 428/320.4 |
| 4,354,449 | 10/1982 | Zink | 118/126 |
| 4,361,108 | 11/1982 | Robillard et al. | 118/265 |
| 4,381,120 | 4/1983 | Golden | 282/27.5 |
| 4,397,483 | 8/1983 | Hiraishi et al. | 282/27.5 |
| 4,407,524 | 10/1983 | Trautlein | 282/9 R |
| 4,425,386 | 1/1984 | Change | 427/256 |
| 4,448,445 | 5/1984 | Chang et al. | 346/206 |
| 4,455,327 | 6/1984 | Yoshida et al. | 427/131 |
| 4,501,559 | 2/1985 | Griswold et al. | 434/154 |
| 4,512,595 | 4/1985 | Breen | 283/70 |
| 4,533,160 | 8/1985 | Malone | 282/23 R |
| 4,556,390 | 12/1985 | Rahn et al. | 434/433 |
| 4,566,720 | 1/1986 | Goldman et al. | 281/15 R |
| 4,576,399 | 3/1986 | White et al. | 282/8 R |
| 4,583,765 | 4/1986 | Messinger | 282/9 R |
| 4,593,935 | 6/1986 | Kearns | 282/28 R |
| 4,597,993 | 7/1986 | Okada et al. | 427/150 |
| 4,614,362 | 9/1986 | Breen et al. | 282/9 R |
| 4,614,363 | 9/1986 | Breen | 282/22 R |
| 4,636,818 | 1/1987 | Jerabek | 346/213 |
| 4,642,662 | 2/1987 | Torii et al. | 346/215 |
| 4,657,783 | 4/1987 | Tatt et al. | 427/211 |
| 4,690,433 | 9/1987 | Showers et al. | 283/1 |
| 4,715,620 | 12/1987 | Thompson | 282/9 R |
| 4,722,553 | 2/1988 | Evans | 282/9 R |
| 4,740,015 | 4/1988 | Caprio et al. | 283/70 |
| 4,745,097 | 5/1988 | Maekawa et al. | 503/209 |
| 4,762,342 | 8/1988 | Thompson | 282/9 R |
| 4,814,319 | 3/1989 | Matsumoto et al. | 503/216 |
| 4,846,594 | 7/1989 | Riskin | 400/188 |
| 4,853,364 | 8/1989 | Liang et al. | 503/216 |
| 4,859,561 | 8/1989 | Metz et al. | 430/138 |
| 4,871,193 | 10/1989 | Wörndli | 283/72 |
| 4,877,767 | 10/1989 | Liang et al. | 503/212 |
| 4,912,080 | 3/1990 | Weinstein | 503/200 |
| 4,935,401 | 6/1990 | Pendergrass, Jr. | 503/206 |
| 4,938,507 | 7/1990 | Ashby et al. | 282/9 R |
| 4,947,343 | 7/1990 | Amari | 364/518 |
| 4,957,380 | 9/1990 | Gerstle et al. | 400/279 |
| 4,959,343 | 9/1990 | Weinstein | 503/200 |
| 4,970,193 | 11/1990 | Liang et al. | 503/201 |
| 4,974,035 | 11/1990 | Rabb et al. | 355/320 |
| 4,977,060 | 12/1990 | Liang et al. | 430/138 |
| 4,977,131 | 12/1990 | Macaulay | 503/201 |
| 4,996,184 | 2/1991 | Bevan et al. | 503/226 |
| 5,002,311 | 3/1991 | Brunjes | 282/9 R |
| 5,004,271 | 4/1991 | Piatt | 283/65 |

FIG 2D
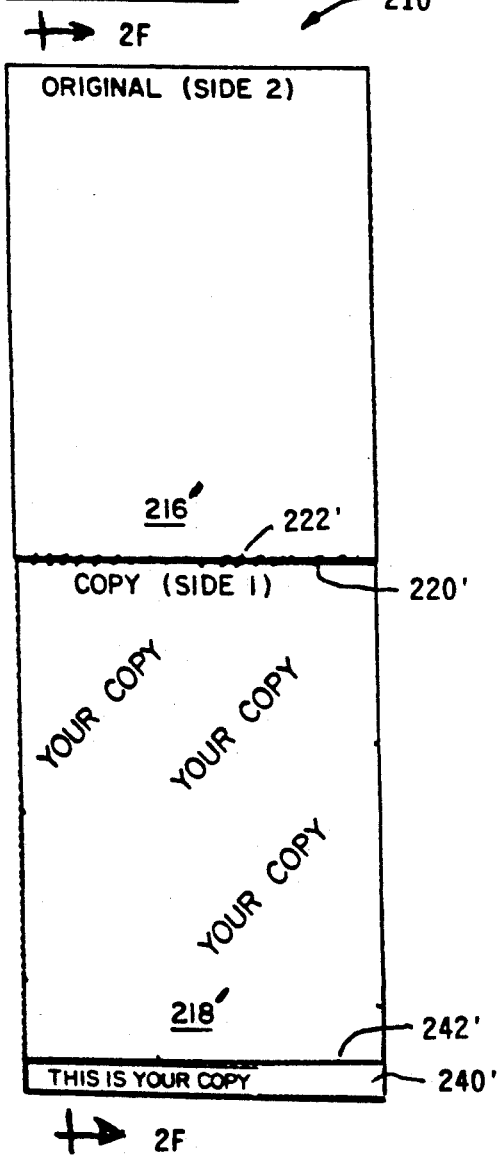
FIG 2E
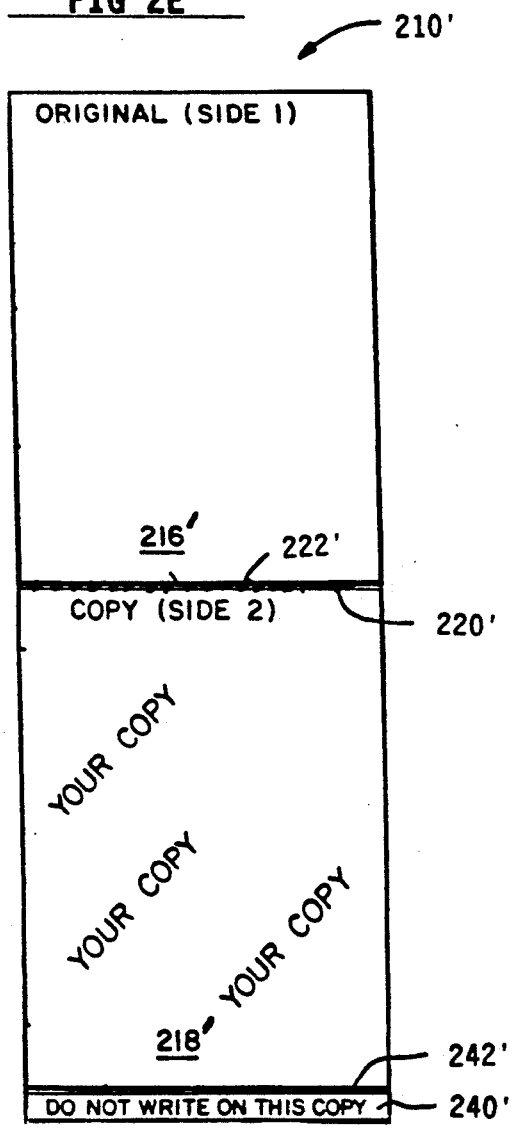
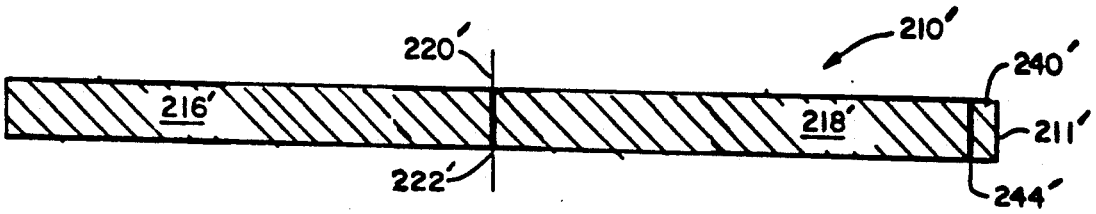
FIG 2F

SELF-REPLICATING DUPLEX FORMS

CROSS-REFERENCE TO RELATED APPLICATIONS

This application is a continuation of U.S. patent application Ser. No. 591,781, filed Oct. 2, 1990, now abandoned which is a continuation-in-part of: U.S. patent application Ser. No. 497,219, filed on Mar. 22, 1990 by Keith E. Schubert and Gerald E. Linden, now U.S. Pat. No. 5,154,668, which is a continuation-in-part of copending U.S. application Ser. No. 494,565, filed on Mar. 16, 1990 by Keith E. Schubert and Gerald E. Linden, now U.S. Pat. No. 5,137,494, which is a continuation-in-part of copending U.S. patent application Ser. No. 484,686, filed Feb. 23, 1990 by Keith E. Schubert, now abandoned, which is a continuation-in-part of copending U.S. patent application Ser. No. 436,189, filed Nov. 13, 1989 by Keith E. Schubert, now U.S. Pat. No. 5,197,922 which is a continuation-in-part of copending U.S. patent application Ser. No. 334,183, filed Apr. 6, 1989 by Keith E. Schubert, now U.S. Pat. No. 5,127,879.

TECHNICAL FIELD OF THE INVENTION

The invention relates to methods and apparatus for replicating information entered on both sides of a duplex form, especially carbonless copying techniques.

BACKGROUND OF THE INVENTION

Carbonless copy forms are well known. A typical two-part form includes a top sheet having a coated back (CB) containing microencapsulated (generally colorless) dye, and a bottom sheet having a coated front (CF) containing a reactive dye-revealing substance. The top and bottom sheets are assembled, such as by gluing, into a "manifold", or many part set, which typically has a "stub". The pressure of writing on the front surface of the top sheet causes the microcapsules on the CB-coated back surface of the top sheet to rupture, releasing dye onto the CF-coated front surface of the bottom sheet, whereupon the writing is revealed in a contrasting (visible) color on the front surface of the bottom sheet.

Multiple carbonless copies are produced in a similar manner. One or more intermediate sheets are assembled between the CB top and CF bottom sheets. Each intermediate sheet has a carbonless front (CF) coating on its front surface for revealing the dye from the previous sheet, and has a carbonless back (CB) coating on its back surface for releasing dye to the next sheet in the set. The intermediate sheets are termed "CFB" sheets.

With these techniques, one or more carbonless copies of information entered on the front surface of the original (top) sheet can be reproduced on the front surface of the copy (intermediate and bottom) sheets.

The chemistry of the CB (image-transferring) and CF (image-revealing) coatings is well known, as are techniques for applying these coatings to paper stock. These coatings and techniques include various coatings applied to paper stock at the mill, as it is being produced, and coatings applied later (typically during the printing process) to plain paper stock. OPAS (On Press Application System) coatings offered by Mead Corporation are an example of the latter.

A variation of the single sided carbonless form is found in so-called "two-way write" systems. One such example is found in U.S. Pat. No. 4,000,916, issued to Lucas, which describes a manifold report form having three superimposed record sheets (top, middle and bottom). Carbon sheets and protective sheets are arranged between the record sheets. Information entered on the front surface of the top record sheet is reproduced on the front surfaces of the middle and bottom sheets. The form is then flipped over, in its entirety, and various carbon and protective sheets are removed. Information entered on the back surface of the bottom sheet is reproduced on the back surface of the middle and top sheets.

With such two-way write systems, a true original is not formed. Rather, each of the top and bottom sheets contains "original" (e.g., hand written) information on only one surface, and "copy" (reproduced by carbon paper or the CB/CF dye reaction) information on the other surface. Such a "bifurcation" of the original information is unsuitable in many applications, such as for legal forms.

U.S. Pat. Nos. 4,715,620 and 4,762,342, issued to Thompson, attempt to solve the challenge of providing a "true" original where the top sheet has "original" information on the front and back surfaces thereof. Therein, top, intermediate and bottom sheets are assembled into a manifold having a stub. Patterned carbon papers and/or carbonless coatings are employed, between the various sheets, as in the two-way write systems. Information is entered on the front surface of the top sheet. The top sheet is then folded around the stub so that its front surface is in contact with the back surface of the bottom sheet. Additional information is then entered on the exposed back surface of the top sheet. The front surface of the top sheet is coated with carbonless CB and the back surface of the bottom sheet is coated with carbonless CF so that the information entered on the back surface of the top sheet is reproduced on the back surface of the bottom sheet.

The problems with Thompson's techniques include the following: 1) It is extremely difficult to maintain registration (alignment) of the top sheet when it is folded around the stub. Hence, it is suggested by Thompson that the stub be gently folded over along with the top sheet. This causes a gap between the top sheet and bottom sheet, which is inapposite to carbonless image forming. The top sheet, when folded over the stub in this manner, must be smoothed out prior to entering the additional information on the back surface of the top sheet. Additionally, if the stub is not folded properly, the top sheet will not be in register with the other sheets when it is flipped over for entering information on the back surface thereof. 2) The carbonless CB coating on the front surface of the top sheet is difficult to write upon. For instance, the tip of a ball point pen will tend to become clogged by dye released from the microcapsules in short order.

The implementation of all of the above-described manifold forms is further complicated by the need for machinery necessary to collate, glue and/or staple individual, dissimilarly coated sheets of paper, carbon papers and protective sheets into a manifold arrangement. This necessitates costly set up charges for the equipment, creates delays in going from paper stock to preprinted form, and creates cumbersome inventory requirements.

Copending U.S. patent application Ser. No. 334,183 and filed on Apr. 6, 1989 by Keith E. Schubert discloses the "genesis" of two-sided (or duplex) copying of both sides of an original form, wherein an original part of a sheet has information entered, such as by pen, on both sides thereof, which information is replicated on both sides of a copy part of the sheet. Techniques for effecting this result using carbon paper and carbonless coatings are disclosed therein.

Copending U.S. patent application Ser. No. 436,189 and filed on Nov. 13, 1989 by Keith E. schubert discloses further techniques for effecting two-sided copying using carbonless coatings, discloses techniques for "patterning" the carbonless coatings, and discloses techniques for making more than one copy of information entered on both sides of an original.

Copending U.S. patent application Ser. No. 484,686 and filed on Feb. 23, 1990 by Keith E. Schubert discloses a technique wherein a single sheet is divided into three panels: an original panel which is void of any carbonless coating; a copy panel which is coated with carbonless CF (image revealing) on both sides; and an intermediate transfer panel which is coated with carbonless CB (image transferring) on both sides.

Copending U.S. patent application Ser. No. 494,565 and filed on Feb. 26, 1990 by Keith E. Schubert and Gerald E. Linden discloses various techniques of patterning coatings on a single sheet of paper to avoid writing in coated areas.

Copending U.S. patent application Ser. No. 497,219 and filed on Mar. 22, 1990 by Keith E. Schubert and Gerald E. Linden discloses techniques for making two copies of information entered on both sides of an original, without patterning, employing two dissimilar carbonless systems.

While all of the above copending U.S. patent applications fully disclose techniques for making duplex copies, certain improvements to the techniques have been developed by the inventors thereof.

DISCLOSURE OF THE INVENTION

It is a general object of the present invention to provide improvements in self-replicating duplex forms.

It is a further object of the invention to provide improved coating techniques for self-replicating duplex forms.

It is a further object of the invention to provide improved "user-friendliness" in self-replicating duplex forms.

It is a further object of the present invention to provide improved manufacturing techniques for self-replicating duplex forms.

It is a further object of the invention to provide improved coating arrangements for self-replicating duplex forms.

It is further object of the present invention to provide improved physical configurations for self-replicating duplex forms.

It is further object of the present invention to provide improved end uses for self-replicating duplex forms.

SUMMARY OF PARENT CASES

By way of summary, according to the inventions disclosed in the parent cases, a single sheet of paper is divided by fold lines into two or more panels (portions), one of which serves as an "original" panel for entering information on both sides thereof, another of which serves as a "copy" panel for reproducing the information entered on both the front and back surfaces of the original panel.

Providing a "set" of carbonless papers, consisting of an original coated on both sides with carbonless CB and a copy coated on both sides with carbonless CF is disclosed.

Fully coating the original panel with carbonless CB on both sides is disclosed.

Patterning the CB coating on the original panel to leave clear areas for entering information on the original panel, and offsetting the clear areas, from front-to-back on the original panel, is disclosed.

Methods and apparatus for ensuring a front-to-back offset of areas for entering information on the front and back surfaces of the original panel are disclosed.

The use of Self-Contained (SC) coatings is disclosed.

Providing self-replicating duplex forms as a single sheet of paper, or as two separate sheets (panels) in a "set" is disclosed.

Dividing a single sheet into three panels by two fold lines is disclosed—an original panel for entering information on both sides thereof, and devoid of any coatings; a copy panel, coated on both sides with carbonless CF, for reproducing the information on both sides thereof, and an intermediate transfer panel, coated on both sides with carbonless CB, for effecting reproduction from the original to the copy panels. Alternatively, the intermediate transfer panel is formed from a separate sheet of paper, and may be coated on only one side thereof with carbonless CB.

The original panel is preferably white, and the copy panel is preferably tinted a dissimilar color, such as pink. With mill stock, the pink tint is usually in the paper stock itself. If employed, the intermediate transfer panel is preferably dissimilarly colored from either of the original or copy panels.

Throughout the various embodiments described in the parent cases, and in the present disclosure, the fold lines are preferably perforated to facilitate folding the various panels one way for filling out variable information on one side ("face", or "Side 1") of the original panel, the other way for filling out variable information on the other side ("back", or "Side 2") of the original panel, and to facilitate separating the various panels after they are completely filled out (i.e., on both sides).

Furthermore, throughout the various embodiments described in the parent cases and in the present disclosure, the side-by-side orientation of the original and copy panels (and intermediate transfer panel) with a vertical fold line is disclosed, as is an orientation wherein the original and copy panels are one above the other with a horizontal fold line.

Generally speaking, throughout the various embodiments described in the parent cases and in the present disclosure, the size of the panels is immaterial. However, most of the examples refer to a duplex (two-sided) form having panels measuring a conventional 8½ by 11 inches.

Throughout the descriptions in this application, cross-references are made to the disclosures of the copending applications, which are incorporated by reference as though fully set forth herein. These cross-references are intended to provide clarity to the descriptions of the improvements described herein, and are not intended to fully summarize the content of the disclosures of the copending applications.

Group 1 Improvements

According to the present invention, an "endorsable" carbonless CB coating is applied to substantially the entire original panel. The "endorsable" CB coating alleviates any pen-skipping problem.

Alternatively, the carbonless CB coating applied to the original panel is "photocopyable", or another off-the-shelf coating which is highly endorsable.

According to the present invention, the thicknesses (equivalent weights) of the CB and CF coatings are closely matched. Preferably, the equivalent weight of the CF coating is increased to nearly match that of the CB coating. This is particularly useful for roll stock, and for individual sheets stacked with the CB panels in register. In the case of dissimilar paper stock, the overall thicknesses of the (coated) paper stocks may be closely matched.

Alternatively, in a stack of unfolded, pre-treated sheets, the stack is "staggered". In other words, a first number of sheets, such as 250–1000 sheets, are stacked in register (CB to CB, CF to CF). A second number of sheets in the stack are reversed, so that their CB panels, while in register with one another, are in register with the CF panels of the first number of sheets. Similarly, the CF panels of the second stack, while in register with one another, are in register with the CB panels of the first number of sheets in the stack. This reverse stacking can be carried out with further numbers of sheets in the stack.

According to the present invention, the paper stock is highly opaque so that fixed and variable information on one side of the form is not noticeable from the other side of the form. Further, the paper stock is sufficiently dense (non-porous) that the CB dye released onto one side of the CF-coated copy panel (for revealing an image on that side) does not "bleed through" to the other side of the CF-coated copy panel (revealing a reverse image on the other side).

According to the present invention, although the original and copy panels are substantially fully coated and able to reproduce writing upon any area of either surface (face or back) of the original panel, specific areas for entering information on the front and back surfaces of the original panel are specified, and delineated such as by pre-printed borders. The areas for entering information on the front surface of the original panel are offset, front-to-back, from the areas for entering information on the back surface of the original panel. This ensures that an area of the CB coating on the front surface of the original panel which is written upon is not employed for carbonless reproduction when writing on the back surface of the original panel, and vice-versa.

According to the present invention, the offset of specific areas for entering information on the front and back of the original panel is manually checked. The checking technique involves creating (either by hand or computer-assisted) a "hard copy" artwork master (for the printing of fixed information and delineations of specific areas for entering information) for Side 1 (front) of the original panel, and superimposing thereupon hard copy of the artwork for Side 2 (back) of the original page. Superimposing Side 1 and Side 2 can be done in various ways, each of which involves printing on a reasonably transparent medium, such as acetate. or even photocopy paper. The artwork masters are then printed, such as by using a photocopier, onto acetate (or other reasonable transparent medium, with registration marks. The two acetates are then placed back-to-back and held up to the light to check for conflicts of areas for filling in information. If such conflicts exist, the specific areas for filling in information on either the front or back of the original panel must be moved to avoid such conflict.

According to the present invention, the form may be printed with "fixed" (pre-printed) information after it is carbonless coated, which is most applicable to "mill stock".

Alternatively, the form may be printed with fixed information prior to carbonless coating, which is most applicable to an on-press coating process, such as OPAS (trademark of Mead).

In either case (i.e., printing before or after coating), printing on both sides can be effected in one pass through a suitable printing press.

Alternatively, one side of the paper can be printed in a first pass on the printing press, and the other side can be printed on a subsequent pass through the press. (In an OPAS process, with multiple colors, it may be necessary to pass the paper stock through the printing press more than twice, to print the various colors and coat the various coatings thereon, if the number of printing-/coating stations is limited.)

According to the present invention, the original panel is one color (preferably white), and the copy panel is tinted a dissimilar color, such as pink, canary, goldenrod or blue. The tint can be incorporated into the paper stock itself (such as it usually is, prior to coating, for mill stock), it can be applied as an ink, appropriately screened (when printing mill stock or when using an OPAS process), it can be applied as a tint, or it can be applied as a coloring in the CF coating deposited on the copy panel. In the case of an intermediate transfer panel, the intermediate transfer panel is preferably tinted a dissimilar color from either of the original and copy panels.

Group 2—Improvements

According to the present invention, in order to provide a visual cue as to the existence of the copy panel behind the original panel, either the copy panel is slightly larger, such as ⅛" to ½" wider than the original (e.g., the copy panel is between 8⅝" and 9" wide), or the original panel is slightly, such as ⅛" to ½" narrower than the copy panel. In either case, the copy panel has a "marginal strip", or "extension" that protrudes, widthwise, discernably beyond the original panel when the form is folded along the boundary 220.

According to a feature of the invention, in the narrow strip of the copy panel that protrudes beyond the original panel, instructions pertaining to the proper use of the form are preprinted. These instructions would contain text such as "YOUR COPY", and/or "FILL IN SIDE 1 OF THE ORIGINAL, RE-FOLD THE FORM, FILL IN SIDE 2 OF THE ORIGINAL".

According to a feature of the invention, a registration line is printed along the marginal strip in register with an outer edge of the original panel.

According to a feature of the invention, the registration line is perforated for removal of the marginal strip after both sides of the original panel are filled in and the original and copy panels are separated.

According to an additional feature of the present invention, a legend notifying the user that the copy panel is "Your Copy" is pre-printed in one or more areas on the front and back sides of the copy panel.

According to a feature of the invention, when the form is filled in with a computer printer, Side 1 of the original panel is filled in, the form is refolded to expose Side 2 of the original panel for entering (variable information) and the left margin offset is increased to compensate for the marginal strip.

Group 3 Improvements

According to the present invention, the original panel is coated on both sides with carbonless CF, the copy panel is coated on both sides with carbonless CF for reproducing information entered on the original panel, and a separate, intermediate transfer panel is coated on only one side with carbonless CB. The intermediate transfer panel is positioned between the original and copy panels so that information entered on one side of the original panel is reproduced on a side of the copy panel, and is positioned again between the re-folded original and copy panels so that information entered on the other side of the original panel is reproduced on the other side of the copy panel. The CF coating on the original panel is "superfluous", in the sense that it does not contribute to the carbonless reproduction of information entered on the original panel. Further, in contrast to some CB coatings, the CF coating is less apt to cause pen-skipping. In the context of the original and copy panels being formed from a single sheet, having an identical (CF) coating on the original and copy panels simplifies production of the paper stock. CF C2S (CF, Coated Two Sides) stock for other purposes is known, and the CB C1S (CB, Coated One Side) intermediate transfer panel is "off the shelf". It is not generally known to re-use a CB sheet, as they typically appear in manifolds for one-way reproduction.

Alternatively, the intermediate transfer sheet can be CFB coated front and back), coated on one surface with CF and coated on the other surface with CB. The CB surface must always be in contact with the copy panel to effect reproduction.

An advantage of this configuration is that the original and copy panels are identically coated, but only the copy panel reproduces, with the intermediate panel inserted. Hence, insofar as paper stock is concerned, it doesn't matter which panel is the original and which panel is the copy.

Further according to the invention, a portfolio-type folder is provided having two covers (sides). The sheet forming the original and copy panels is folded and stored on one side of the portfolio. The intermediate transfer sheets are stored on the other side of the portfolio.

A variant configuration is to have plain paper original and copy panels, preferably manufactured from a single folded sheet of plain paper. An intermediate carbon panel would be inserted therebetween to effect reproduction of information entered on both sides of the original panel onto both sides of the copy panel.

Group 4 Improvements

According to the present invention, paper stock for the original and copy panels are produced independently, and are joined using a variety of techniques into a single "virtual" sheet. The joining techniques are applicable to the various coating configurations discussed herein, as well as hereinbefore in the copending U.S. patent applications.

In some of the configurations, off-the shelf carbonless paper stock is advantageously employed.

According to the invention, in order to obtain various configurations of uncoated, CB-coated and CF-coated surfaces on the various panels of the form, off-the-shelf carbonless CB, CF, CFB and/or CF C2S stock is laminated to provide the appropriate coatings in the proper locations.

Further according to the invention, the thickness of the laminated article is in the range of 20–24# (pounds).

The improvements of the various groups (1–4) set forth above, and described in greater detail below, can be combined in various ways to make the self-replicating form easier to use and more manufacturable.

Other objects, features and advantages of the invention will become apparent in light of the following description thereof.

BRIEF DESCRIPTION OF THE DRAWINGS

FIG. 2D is a top plan view of another embodiment of the form of FIG. 2A.

FIG. 2E is a bottom plan view of the form of FIG. 2D.

FIG. 3F is a cross-sectional view of a self-replicating duplex form, showing an alternate embodiment of a technique for joining two panels a "virtual" sheet.

Generally, throughout the descriptions that follow, a sheet of paper (#11) has a front surface (#12) and a back surface (#14) and is divided by a perforated fold line (#20) into two "panels" an "original" panel (#16) for entering information on both sides thereof, and a "copy" panel (#18) for replicating information on both sides thereof. Each of the panels has a front surface defined by the front surface of the sheet and a back surface defined by the back surface of the sheet. (In the numbering scheme throughout the figures, there is a general correspondence of the aforementioned numbers indicated by a "#" prefix, where "#" is the figure number.) Each of the panels has an "inner" edge along the fold line.

In cases where separate original and copy panels are discussed, they may ultimately be joined into a "virtual" single sheet of paper. Similarly, in the laminated constructions discussed herein, various laminate panels are assembled into a single laminated sheet.

It should be understood that the concept of a single sheet of paper is not limited to single sheets, per se, but also includes paper produced on a roll which is typically cut into single sheets either before or after printing.

DETAILED DESCRIPTION OF THE INVENTION

GROUP 1 IMPROVEMENT

Figure 1A:
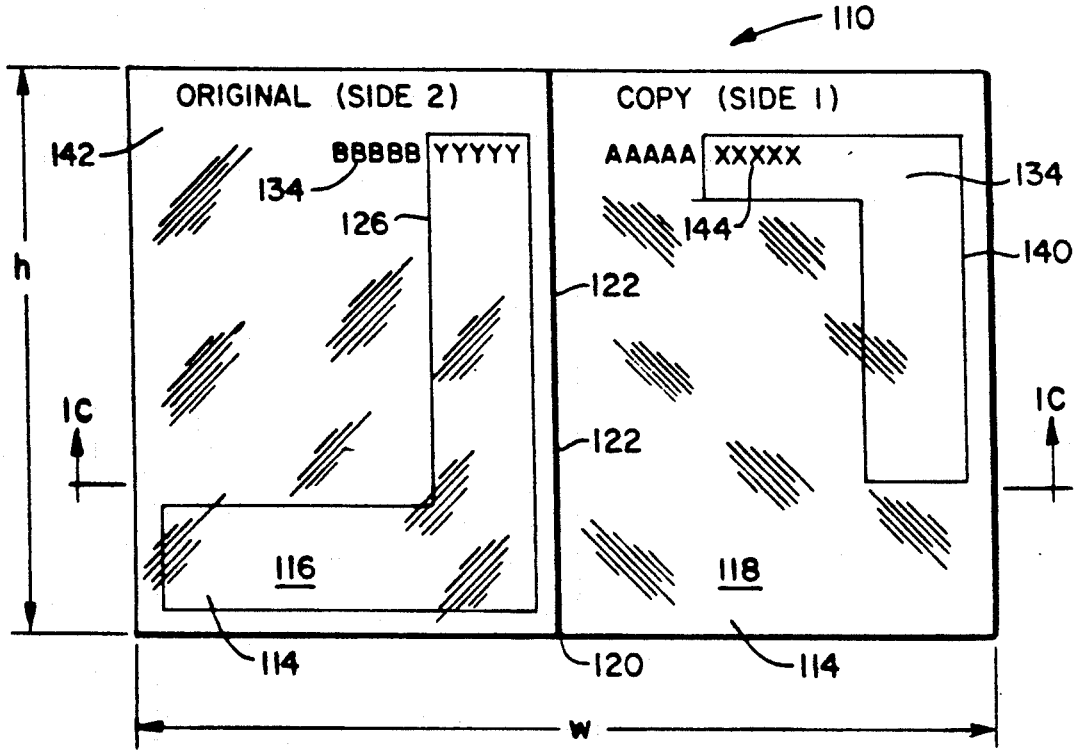
FIG. 1A is a top plan view of a self-replicating duplex form.
Figure 1B:
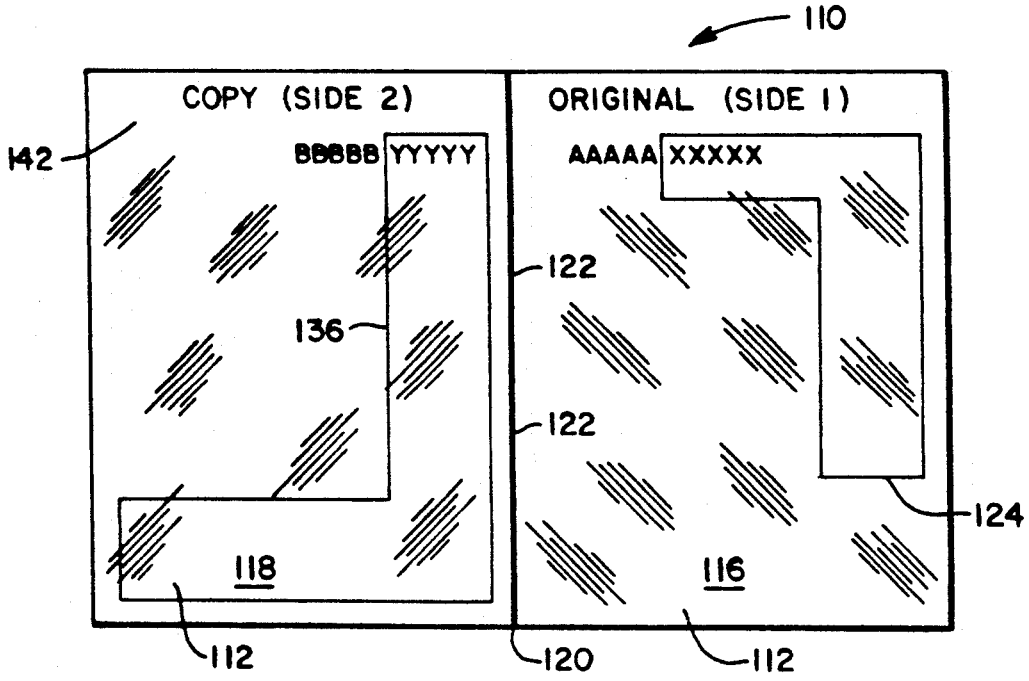
FIG. 1B is a bottom plan view of the form of FIG. 1A.
Figure 1C:
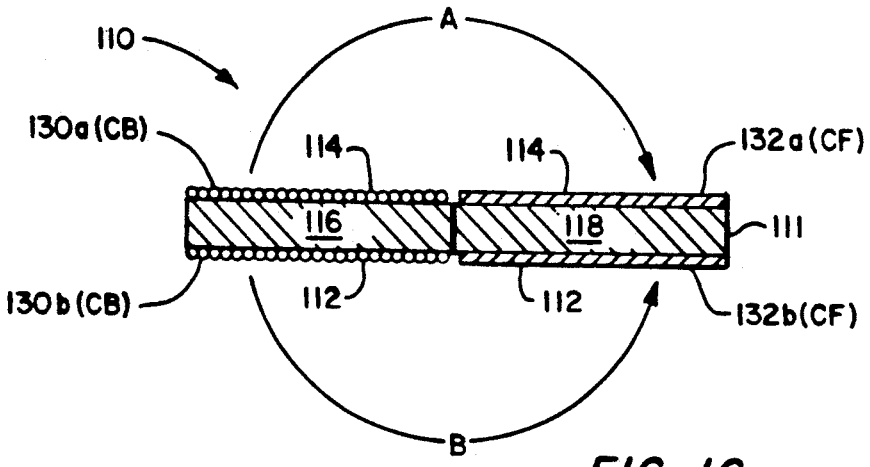
FIG. 1C a cross-sectional view of the form of FIG. 1A.

FIGS. 1A–1C show a self-replicating form 110 comprising a single sheet of paper 111 having a front surface 112 and a back surface 114. The sheet is divided into an "original" panel 116 and a "copy" panel 118 by a fold line 120. The fold line is provided with a series of perforations 122 for folding and separating the two panels 116, 118. The sheet has a height (h) and a width (w), and the fold line bisects the width. In the case where the height and width are eleven inches and seventeen inches, respectively, the original and copy panels each measure $8\frac{1}{2}\times 11$ inches, which is a common size for a form or other stationery article. The present invention is not limited to these dimensions, nor is it limited to a vertical fold line.

The following legends appear on the top of the panels, as an aid to following the description, but would not necessarily be printed on the form: "ORIGINAL (SIDE 2)" on the front surface 112 of the original panel 116; "ORIGINAL (SIDE 1)" on the back surface 114 of the original panel 116; "COPY (SIDE 1)" on the back surface 114 of the copy panel 118; and "COPY (SIDE 2)" on the front surface 112 of the copy panel 118.

A specific area 124 on the front surface 112 of the original panel 116 is designated for the user filling in (entering) first "variable" information (represented by "XXXXX"), such as with a pen or typewriter. The remaining area of the front surface 112 of the original panel 116 may be utilized for providing first pre-printed, "fixed" information (represented by "AAAAA") on the form 110.

A specific area 134 on the back surface 114 of the copy panel 118 is aligned with the area 124 on the front surface 112 of the original panel 116, when the form 110 is folded one way, as indicated by the arrow "A", and reproduces the variable information ("XXXXX") entered in the area 124 on the front surface 112 of the original panel 116.

A specific area 126 on the back surface 114 of the original panel 116 is designated for the user filling in (entering) second "variable" information (represented by "YYYYY"), such as with a pen or typewriter. The remaining area of the back surface 114 of the original panel 116 may be utilized for providing second pre-printed, "fixed" information (represented by "BBBBB") on the form A specific area 136 on the front surface 112 of the copy panel 118 is aligned with the area 126 on the back surface 114 of the original panel 116, when the form 110 is folded another, opposite way, as indicated by the arrow "B", and reproduces the variable information ("YYYYY") entered in the area 126 on the back surface 114 of the original panel 116.

The areas 124, 126, 134 and 136 can each comprise several non-contiguous areas. Only one area is shown for each, for illustrative clarity.

In order to effect reproduction of information entered on both sides of the original panel 116 onto both sides of the copy panel 118, the form is coated with carbonless coatings, as follows.

A carbonless CB treatment **130*a* is applied to substantially the entire back surface 114 of the original panel 112 for transferring an image of the first variable information ("XXXXX") entered on the front surface 112 of the original panel 116 onto the back surface 114 of the copy panel 118. A carbonless CF treatment 132*a* is applied to substantially the entire back surface 114 of the copy panel 118 for revealing an image of the first variable information ("XXXXX") entered on the front surface 112 of the original panel 116**.

A carbonless CB treatment **130*b* is applied to substantially the entire front surface 112 of the original panel 112** for transferring an image of the second variable information ("YYYYY") entered on the back surface 114 of the original panel 116 onto the front surface 112 of the copy panel 118. A carbonless CF treatment 132*b* is applied to substantially the entire front surface 112 of the copy panel 118 for revealing an image of the second variable information ("YYYYY") entered on the back surface 114 of the original panel 116.

In use, the panels are folded one way, as indicated by the arrow "A", to enter information on the front of the original panel, and are folded another way, as indicated by the arrow "B", to enter information on the back of the original panel. This information is reproduced on the back and front surfaces, respectively, of the copy panel, as explained above. The form is then unfolded and the panels are separated along the perforations 122 of the fold line 120.

In copending U.S. application Ser. No. 334,183, coating substantially the entire front and back surfaces of the original and copy panels with carbonless CB and CF treatments, respectively, was discussed. As noted in copending U.S. application Ser. No. 436,189, some CB coatings tend to clog the tips of ball point pens, thereby causing pen skipping (difficulty in entering information on a CB coated area of the original panel). The solution proposed in copending U.S. patent application Ser. No. 436,189 was applying the coatings only to specific, offset areas on the face (front) and back of the original panel (offset patterning of the CB coatings).

According to the present invention, the carbonless CB coating applied to the original panel is an "endorsable" coating which does not cause a pen to skip when written upon. Empirical testing by the applicants has shown that certain CB coatings, such as those described in U.S. Pat. Nos. 3,016,308 and 3,429,827 (assigned to Moore Business Forms) and "AQUEOUS OPAS" (under development by MEAD/OPAS) are highly "endorsable". Other off-the-shelf coatings have varying degrees of endorsability. The CF coating on the copy panel must be reactive with the selected CB coating.

The carbonless CB coating applied to the original panel may also be selected from a class of coatings that are "photocopyable". Applicants' tests of photocopyable CB coatings indicate that they exhibit a high degree of endorsability. In other words, they accept a substantial amount of writing without causing any pen skipping problem. Examples of photocopyable carbonless coatings are "RALLY" (available from Appleton Papers) and "TARTAN" (available from MEAD). Photocopyable carbonless paper is also available from Xerox Corp., and contains uniformly small CB microcapsules.

Testing by applicants has demonstrated that writing in a coated area one side of the original panel does not visibly affect the ability of that coated area to transfer an image when information is entered in a perfectly aligned area on the other side of the original panel. Nevertheless, the possibility exists in some applications, and using some types of carbonless coatings, that the "superfluous" release of dye from the written-upon CB coating will attenuate the ability of that CB coating to transfer an image, when writing from the other side of the form.

According to the present invention, although the original and copy panels are substantially fully coated (i.e., with endorsable CB) and able to reproduce variable information entered upon any area of either surface (face or back) of the original panel, advantageously specific areas 124 and 126 for entering information on the front and back surfaces, respectively, of the original panel 116 are specified, and delineated such as by preprinted borders. The areas 124 for entering information on the front surface 112 of the original panel 116 are offset, front-to-back, from the areas 126 for entering information on the back surface 114 of the original panel 116. This ensures that an area of the CB coating on the front surface of the original panel which is written upon (i.e., the area 124) is not employed for carbonless reproduction when writing on the back surface of the original panel, and viceversa.

Methods and apparatus for ensuring a front-to-back offset of areas for entering information on the front and back surfaces of the original panel are disclosed in copending U.S. patent application Ser. No. 494,565, and are incorporated by reference herein.

According to the present invention, the offset of specific areas for entering information on the front and back of the original panel is manually checked. The checking technique involves creating (either by hand or computer-assisted) a "hard copy" artwork master (for the printing of fixed information and delineations of specific areas for entering information) for Side 1 (front) of the original panel, and superimposing thereupon hard copy of the artwork for Side 2 (back) of the original page. Superimposing the artwork for Side 1 and Side 2 can be done in various ways, each of which involves printing on a reasonably transparent medium, such as acetate, or even photocopy paper. The artwork masters are then printed, such as by using a photocopier, onto acetate (or other reasonably transparent medium), preferably with registration marks. The two acetates are then placed back-to-back (with registration marks aligned) and viewed (such as by holding up to the light source) to check for "conflicts" (superposition) of areas for filling in information on the front (face) and back of the original panel. If such a conflict exists, the layout of either the front or back of the original panel must be modified to ensure that there is a front-to-back offset of all areas for filling in information.

Inasmuch as the invention described in the parent and present cases deals with the making of a two-sided copy of information entered on both sides of an original panel (e.g., form), it is desirable that information entered or reproduced on one side of the original and copy panel, respectively, does not show through when viewing the other side of the original and copy panel, respectively.

According to the present invention, the paper stock is highly opaque so that fixed and variable information on one side of the form is not readily perceived from the other side of the form. Further, the paper stock is sufficiently dense (non-porous) that the CB dye released onto one side of the CF-coated copy panel (for revealing an image on that side) does not "bleed through" to the other side of the CF-coated copy panel (revealing an undesirable "reverse image" on the other side). Preferably, the form is made from 20# (twenty pound) paper stock, such as "form bond".

In FIG. 1C, it appears that the CB and CF coatings are closely matched in thickness (although the drawings are merely illustrative, and exaggerated to aid in understanding the invention). In reality, in most carbonless coating processes, the CB coating tends to be measurably thicker than the CF coating. Typical equivalent weights for the CB coating are 1.5 pounds, and typical equivalent weights for the CF coating are 0.3 pounds. (As used herein, "equivalent weight" is an indicator of actual thickness.) Inasmuch as the original panel has two thicknesses of CB coating (one each on the front and back surfaces), and the copy panel has two thicknesses of CF coating (one each on the front and back surfaces), the original panel would normally be loaded with approximately 3.0 pounds of CB coating, and the copy panel would be loaded with 0.6 pounds of CF coating. In a stack of unfolded, carbonless-coated sheets (such as shown in FIGS. 1A and 1B), laid flat with the CB panels in register and the CF panels in register, eventually, if the stack was high enough, the different coating loading would become noticeable. Similarly, in a roll of carbonless-coated paper, a thickness difference would become evident, and the roll would tend to assume a conical profile. Such a thickness difference between the CB and CF coatings can possibly present a handling problem.

According to the present invention, the thicknesses (equivalent weights) of the CB and CF coatings are closely matched (as illustrated in FIG. 1C). Preferably, the equivalent weight of the CF coating is increased to nearly match that of the CB coating, rather than vice-versa. (A minimum CB thickness is required to maintain reproduction quality.) This is particularly useful for roll stock, and for individual sheets stacked with the CB panels in register.

Alternatively, when joining a CB-coated original panel to a CF-coated copy panel, as described below (Group 3 Improvements), the paper stock thicknesses can be adjusted to provide an overall correspondence of thickness between the CB-coated original panel and the CF-coated copy panel, taking into account the thickness of the paper and any coatings thereon. This is also applicable in the case of an un-coated original panel, such as is discussed in the aforementioned U.S. patent application Ser. No. 484,686.

In either case, an additional benefit of the present invention is evident, in that CB-coated panels stacked in register (on unfolded sheets or separate panels) will not be in contact with CF-coated, dye-revealing panels. Contact of CB and CF surfaces presents problems of creating spurious images during storage and handling, which are discussed in U.S. Pat. No. 4,062,567 (Macaulay).

Alternatively, in a stack of unfolded, coated sheets having unequally weighted panels, the stack is "staggered". In other words, a first number of sheets, such as 250–1000 sheets, are stacked in register (CB to CB, CF to CF). A second number of sheets in the stack are reversed, so that their CB panels, while in register with one another, are in register with the CF panels of the first number of sheets. Similarly, the second number of CF panels, while in register with one another, are in register with the CB panels of the first number of sheets in the stack. This "reverse stacking" can be carried out with further numbers of sheets in the stack.

There are basically two techniques for coating paper stock for this invention the paper can be coated with carbonless coatings at the paper mill, or it can be coated "on press", such as with OPAS (On Press Application System) coatings. With already coated mill stock, the paper is printed after being coated. With OPAS, the paper is usually printed immediately prior to being coated.

According to the present invention, the form 110 is printed with fixed information after carbonless coatings are applied thereto.

Alternatively, the form 110 is printed with fixed information prior to (or in connection with) carbonless coatings being applied thereto.

In either case, printing on both sides can be accomplished in a single pass through a suitable printing press. Alternatively, one side of the paper can be printed (and OPAS coated) in one pass on the printing press, and the other side can be printed on a subsequent pass through the press. Registration of the printed information from one side to the other side of the form is critical in either case, and in the case of two (or more) passes, a reinsertion press would be required.

As disclosed in copending U.S. patent application Ser. No. 334,183, the original panel is preferably white, and the copy panel is preferably tinted a dissimilar color, such as pink. With mill stock, the pink tint is usually in the paper stock itself. As disclosed in copending U.S. patent application Ser. No. 484,686, the intermediate transfer panel may be dissimilarly colored from either of the original or copy panels.

According to the present invention, the tint on the copy (or intermediate transfer) panel can be 1) incorporated in the paper stock itself, which is most appropriate for mill stock, and which is most applicable to the "Group 4" joining improvements described hereinbelow, 2) applied as an ink, appropriately screened, which is most appropriate for the single sheet embodiments of the present invention, 3) applied in a tinting process, or 4) it can be applied as a coloring in the carbonless coating deposited on the panel being tinted. The latter three techniques (2,3 and 4) are most applicable to OPAS processes.

As noted below ("Group 2 Improvements"), the copy panel can be larger (wider) than the original panel.

Also, as noted below ("Group 3 Improvements"), an additional intermediate transfer sheet can be provided to eliminate the need for having carbonless CB coatings on the original panel.

Also, as noted below ("Group 4 Improvements"), the original and copy panels can be produced as separate sheets, to be joined later into a single "virtual" sheet, or can be produced as a laminated article.

Group 2 Improvements

As indicated by the arrow "A" in FIG. 1A, sheets, once printed with fixed information, are best provided to the user in a folded configuration, with the copy panel behind the original panel, and Side 1 of the original panel 116 exposed for entering information on the face 112 of the original panel 116. If the original and copy panels are of closely matched dimension (e.g., $8\frac{1}{2}'' \times 11''$ each), it may not be immediately apparent to the end user that there are two panels in the folded form.

According to the present invention, in order to provide a visual cue as to the existence of the copy panel behind the original panel, the copy panel is larger than the original panel. In a side-by-side orientation of the original and copy panels, the copy panel would be wider than the original panel. This can be accomplished in one of two ways: either the copy panel is slightly, such as $\frac{1}{8}''$ to $\frac{1}{2}''$ wider than the original (i.e., the copy panel is between $8\frac{5}{8}''$ and $9''$ wide), or the original panel is slightly, such as $\frac{1}{8}''$ to $\frac{1}{2}''$ narrower than the copy panel. In either case, the copy panel has a "marginal strip", or "extension" that protrudes, widthwise, discernably beyond the original panel when the form is folded along the boundary (220). In cases where the copy and original panels are disposed one atop the other (as shown in FIGS. 1P and 1Q of U.S. patent application Ser. No. 436,189), the copy panel is advantageously longer than the original panel. Providing a wider copy panel is discussed hereinbelow.

Figure 2C:
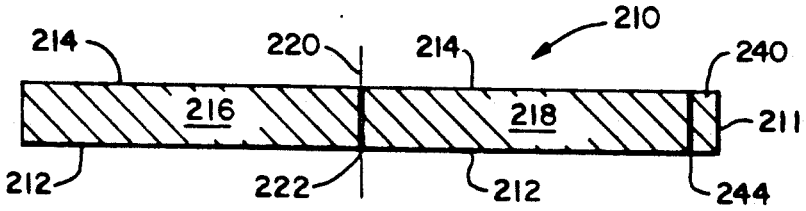
FIG. 2C is a cross-sectional view of the form of FIG. 2A.
Figure 2A:
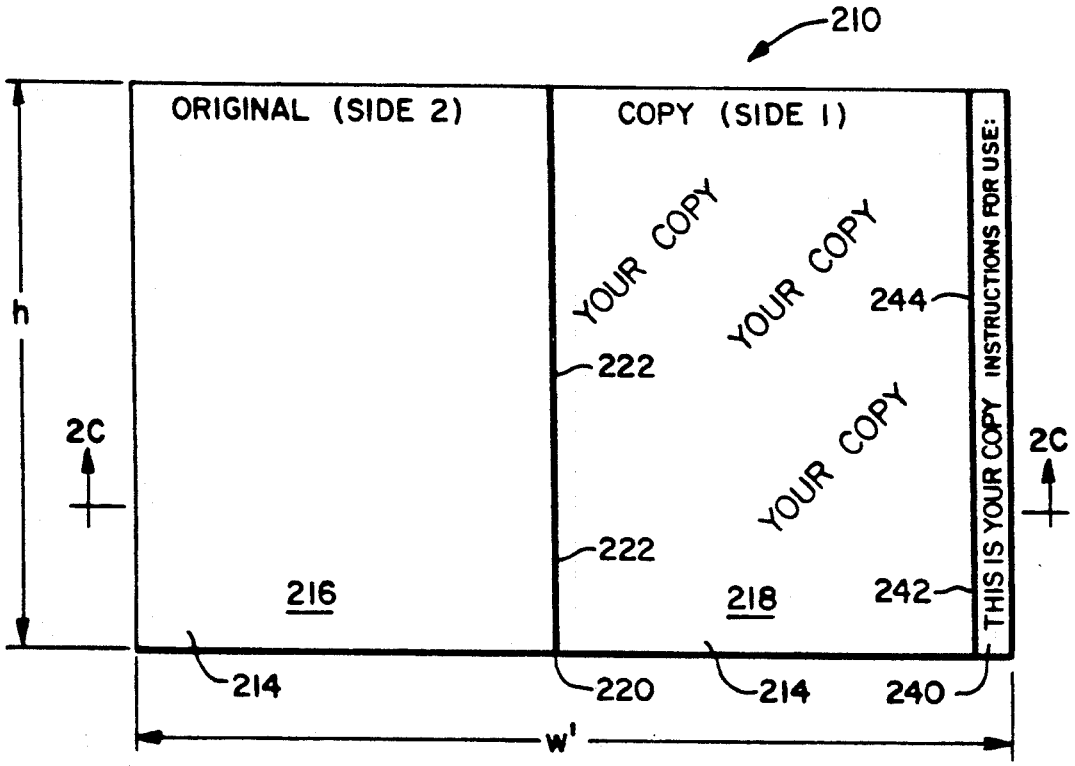
FIG. 2A is a top plan view of a self-replicating duplex form.
Figure 2B:
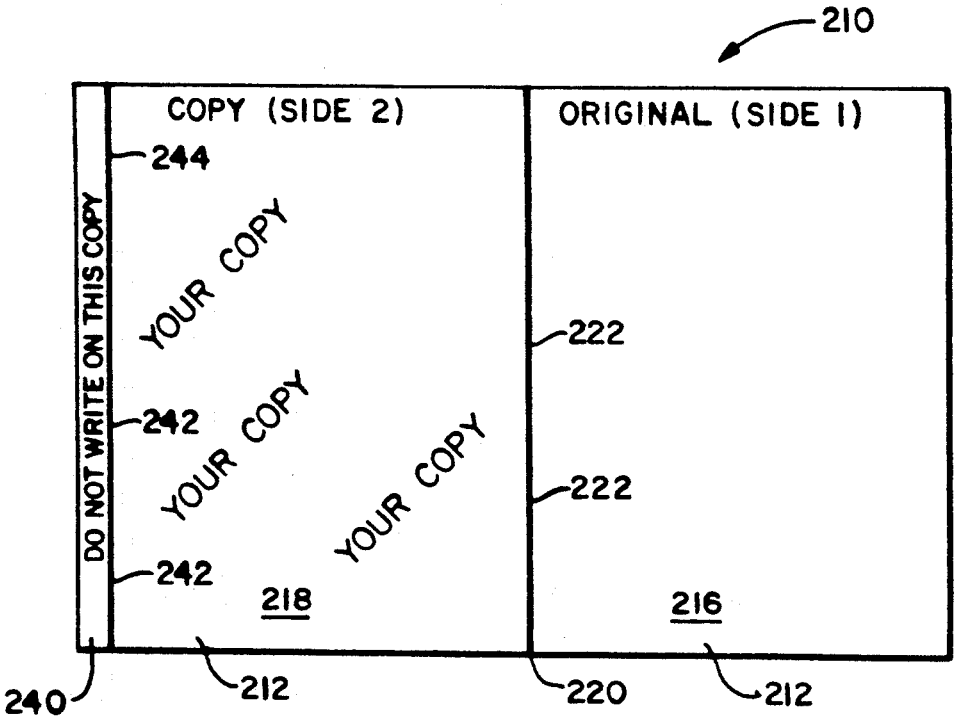
FIG. 2B is a bottom plan view of the form of FIG. 2A.

FIGS. 2A–2C show self-replicating form 210 comprising a single sheet of paper 211 having a front surface 212 and a back surface 214. The sheet is divided into an "original" panel 216 and a "copy" panel 218 by a fold line 220. The fold line is provided with a series of perforations 222 for folding and separating the two panels 216, 218. The sheet has a height (h) and a width (w'), and, unlike the form 110, the fold line 220 does not "exactly" bisect the width. Rather, in the case where the height and width are eleven inches and 17½ inches, respectively, the original panel measures 8½ inches wide by 11 inches high, which is a common size for a form, and the copy panel measures 9 inches wide by 11 inches high. The present invention is not limited to these dimensions, nor to a vertical fold line. In FIGS. 2A, 2B and 2C, the form is shown without carbonless coatings and without specific areas for entering variable information delineated, for illustrative clarity, as well as to provide utility in descriptions of other coating configurations (e.g., Group 3 Improvements) discussed herein.

Because the copy panel 218 is wider than the original panel 216, a marginal strip 240 along the outer edge of the copy panel is exposed when the form is folded (either way).

According to the invention, a "registration" line 242 may be printed at a position along the edge of the copy panel, in register with the outer edge of the original panel (when the form is folded), e.g. at 8½ inches from the fold 420.

Further, whether or not the registration line 242 is actually printed, a line of perforations 244 may be disposed along that line. In this manner, once the form is completely filled in on both sides, the marginal strip 420 can easily be removed, thereby providing original and copy panels of the same dimension (e.g., 8½ inches wide).

According to a feature of the invention, in the marginal strip 240 of the copy panel 218 that protrudes beyond the original panel 216 (when folded), instructions pertaining to the proper use of the form are preprinted (as "fixed" information). These instructions would contain text such as "THIS IS YOUR COPY INSTRUCTIONS FOR USE:", which would be visible on the back surface 214 of the copy panel 218 when the form is folded one way for entering information on the face 212 of the original panel 216, and "DO NOT WRITE ON THIS COPY", which would be visible on the front surface 212 of the copy panel 218 when the form is folded the other way for entering information on the back 214 of the original panel 216.

FIGS. 2D–2F show a self replicating form 210', similar to the form 210 of FIGS. 2A–2C, except that the original panel is disposed atop (above) the copy panel. As mentioned above, this corresponds to the orientation illustrated in FIGS. 1P and 1Q of U.S. patent application Ser. No. 436,189.

In this case, the sheet 211' is divided into an "original" panel 216' disposed vertically above a "copy" panel 218' by a horizontal fold line 220'. The fold line is provided with a series of perforations 222' for folding and separating the two panels 216' and 218'. The fold line 220' does not "exactly" bisect the sheet. Rather, it is offset so that the copy panel is longer than the original panel. In FIGS. 2D, 2E and 2F, the form is shown without carbonless coatings and without specific areas for entering variable information, for illustrative clarity, as well as to provide utility in descriptions of other coating configurations (e.g., Group 3 Improvements) discussed herein.

Because the copy panel 218' is longer than the original panel 216', a marginal strip 240' along the outer edge of the copy panel is exposed when the form is folded (either way). As in FIGS. 2A–2C, a registration line 242' may be printed at a position along the edge of the copy panel, in register with the outer edge of the original panel (when the form is folded).

Further, a line of perforations 244' may be disposed along the position of registration line, whether the registration line is printed or not. In this manner, once the form is completely filled in on both sides, the marginal strip 240' can easily be removed, thereby providing original and copy panels of the same dimension. In other respects, as set forth below, the form 210' is essentially similar to the form 210.

According to an additional feature of the present invention, further "cues" are provided to the user to indicate that the copy panel is for reproducing information, not for entering it. These could include legends such as "YOUR COPY" pre-printed as fixed information in a "random repeat" pattern across the front and back surfaces of the copy panel (generally exclusive of the area defined by the marginal strip). Preferably, these legends are "screened" (printed in a dot pattern having 5–20% density) so they won't obscure other information on the form.

These various cues, that the original panel is for entering variable information (i.e., filling in the form) and that the copy panel should not be written upon, including tinting the copy panel ("Group 1 Improvements"), providing a marginal strip on the copy panel extending beyond the edge of the original panel when the form is folded (either way), providing legends in the marginal strip (and instructions for use of the form), and providing legends on the front and back surfaces of the copy panel, should ensure that the form is properly utilized Although many duplex forms are filled in by hand, variable information may be entered with a typewriter or computer printer. When filling out Side 1, the fold (220; i.e., the inner edges of the original and copy panels) is to the left of the form, and can be aligned against the left margin "stop" of a typewriter or printer. When the form is re-folded to enter information on Side 2 of the original panel, the fold (220) is to the right, and the marginal strip (240; e.g., outer edge of the copy panel) is to the left. With the extreme outward edge of the copy panel abutting the left margin stop of the typewriter or printer, this will cause a rightward shift of the form, equivalent to the width of the marginal strip. When using a typewriter, this would not present much of a problem. However, when using a computer printer, spaces for filling in information on the back of the original panel would be shifted ½ inch to the right of where they otherwise (without the marginal strip) are supposed to be. (This would not be a problem if the marginal strip were removed prior to printing on Side 2.)

According to the invention, when the form 210 is filled in with a computer printer, printing on the back (Side 2) of the original panel is caused to shift to the right an amount equivalent to the width of the marginal strip 240 (e.g., ½ inch) to ensure proper registration of variable information being entered with the space (e.g., 126, 136 of FIGS. 1A and 1B) where it is supposed to be entered (and reproduced).

As noted above ("Group Improvements"), the equivalent weights of the original and copy panels can be made equal.

Also, as noted below ("Group 3 Improvements"), an additional intermediate transfer sheet can be provided to eliminate the need for having carbonless CB coatings on the original panel.

Also, as noted below ("Group 4 Improvements"), the original and copy panels can be produced as separate sheets, to be joined later into a single "virtual" sheet, or can be produced as a laminated article.

Group 3 Improvements

Figure 4C:
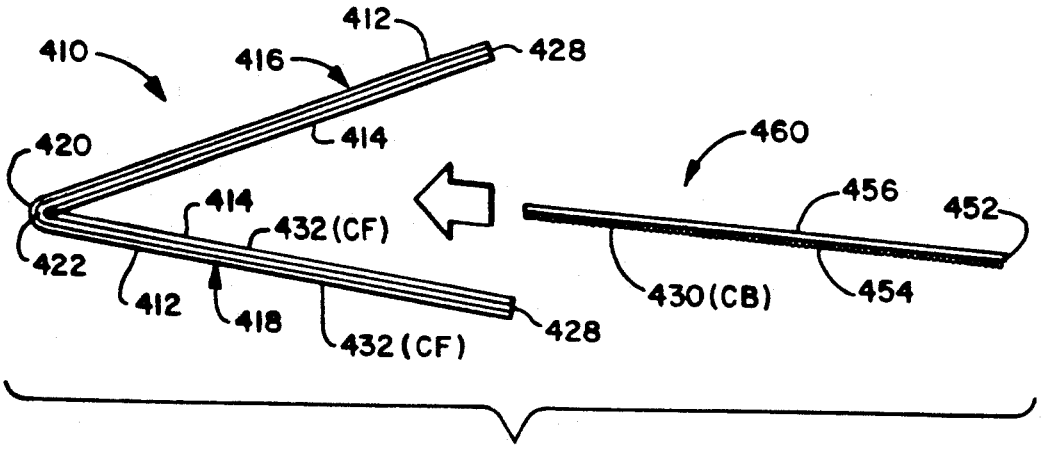
FIG. 4C is a cross-sectional view of the self-replicating form of FIG. 4A.
Figure 4A:
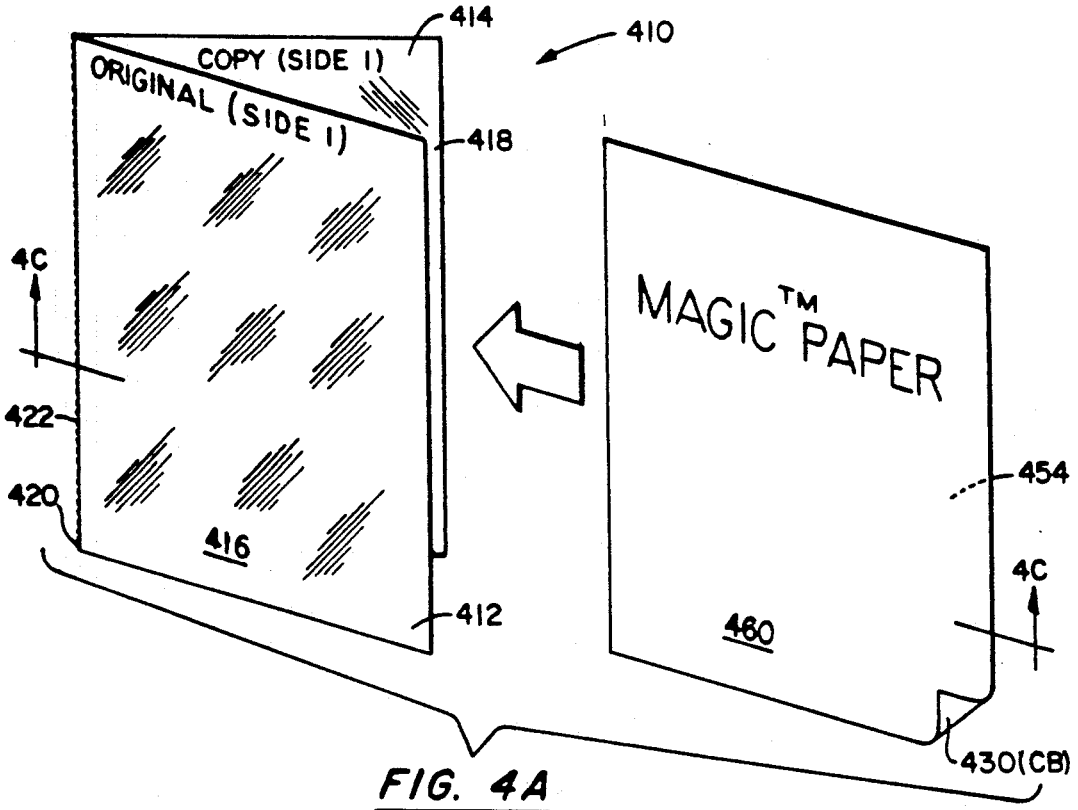
FIG. 4A is a perspective view of a self-replicating duplex form, partially folded one way.
Figure 4B:
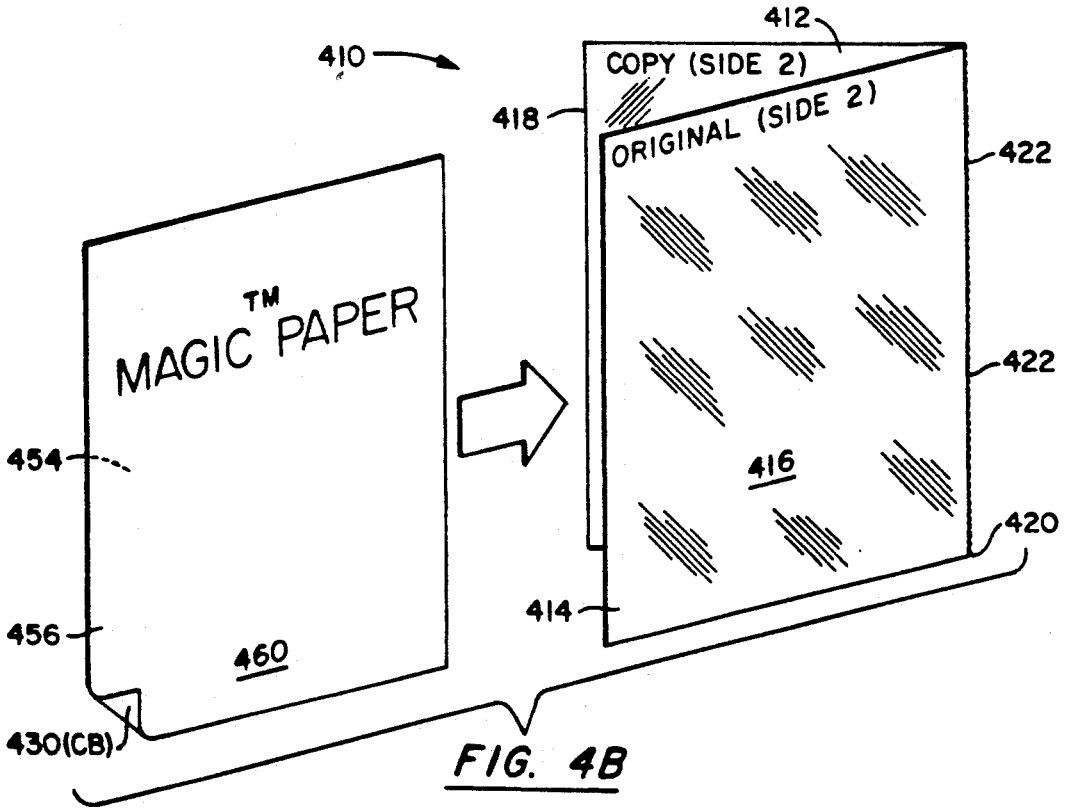
FIG. 4B is a perspective view of the self-replicating form of FIG. 4A, folding another way.

FIGS. 4A–4C show a form 410 comprising a single folded sheet 411 of paper, having a front surface 412 and a back surface 414. The sheet is divided into an "original" panel 416 and a "copy" panel 418 by a fold line 420. The fold line is provided with a series of perforations 422 for folding and separating the two panels 416, 418. The sheet has a height and a width. The fold line 420 may bisect the width, as in FIGS. 1A–1C, so that the original and copy panels are both $8\frac{1}{2} \times 11$ inches. Preferably, the sheet is wider and the copy panel is provided with a marginal extension (240), as shown in FIGS. 2A–2C, so that the original panel is $8\frac{1}{2} \times 11$ inches and the copy is wider (e.g. $9 \times 11$ inches). The present invention is not limited to these dimensions, nor to a vertical fold line.

In marked contrast to the tendency of CB coatings causing pen-skipping, it is noted that CF coatings tend not to interfere with writing, such as with a ball point pen.

According to the present invention, the original panel is coated with both sides with carbonless CF 432, the copy panel is coated on both sides with carbonless CF for reproducing information entered on the original panel, and a separate, intermediate transfer panel 460 is coated on only side with carbonless CB 430. As in copending U.S. application Ser. No. 484,686, the intermediate transfer panel is positioned between the original and copy panels so that information entered on one side of the original panel is reproduced on a side of the copy panel, and is re-positioned between the re-folded original and copy panels so that information entered on the other side of the original is reproduced on the other side of the copy panel. The CF coating on the original panel is "superfluous", in the sense that it does not contribute to the carbonless reproduction of information entered on the original panel. However, in the context of the original and copy panels being formed from a single sheet, having an identical (CF) coating on the original panel simplifies production of the paper stock.

Alternatively, the intermediate transfer sheet can be CFB coated front and back), coated on one surface with CF and coated on the other surface with CB. The CB surface must always be in contact with the copy panel to effect reproduction.

An advantage of this configuration is that the original and copy panels are identically coated, but only the copy panel reproduces, with the intermediate panel inserted. Hence, insofar as paper stock is concerned, it doesn't matter which panel is the original and which panel is the copy.

A variant configuration is to have plain paper original and copy panels, preferably manufactured from a single folded sheet of plain paper. An intermediate carbon panel would be inserted therebetween to effect reproduction of information entered on both sides of the original panel onto both sides of the copy panel.

Figure 5:
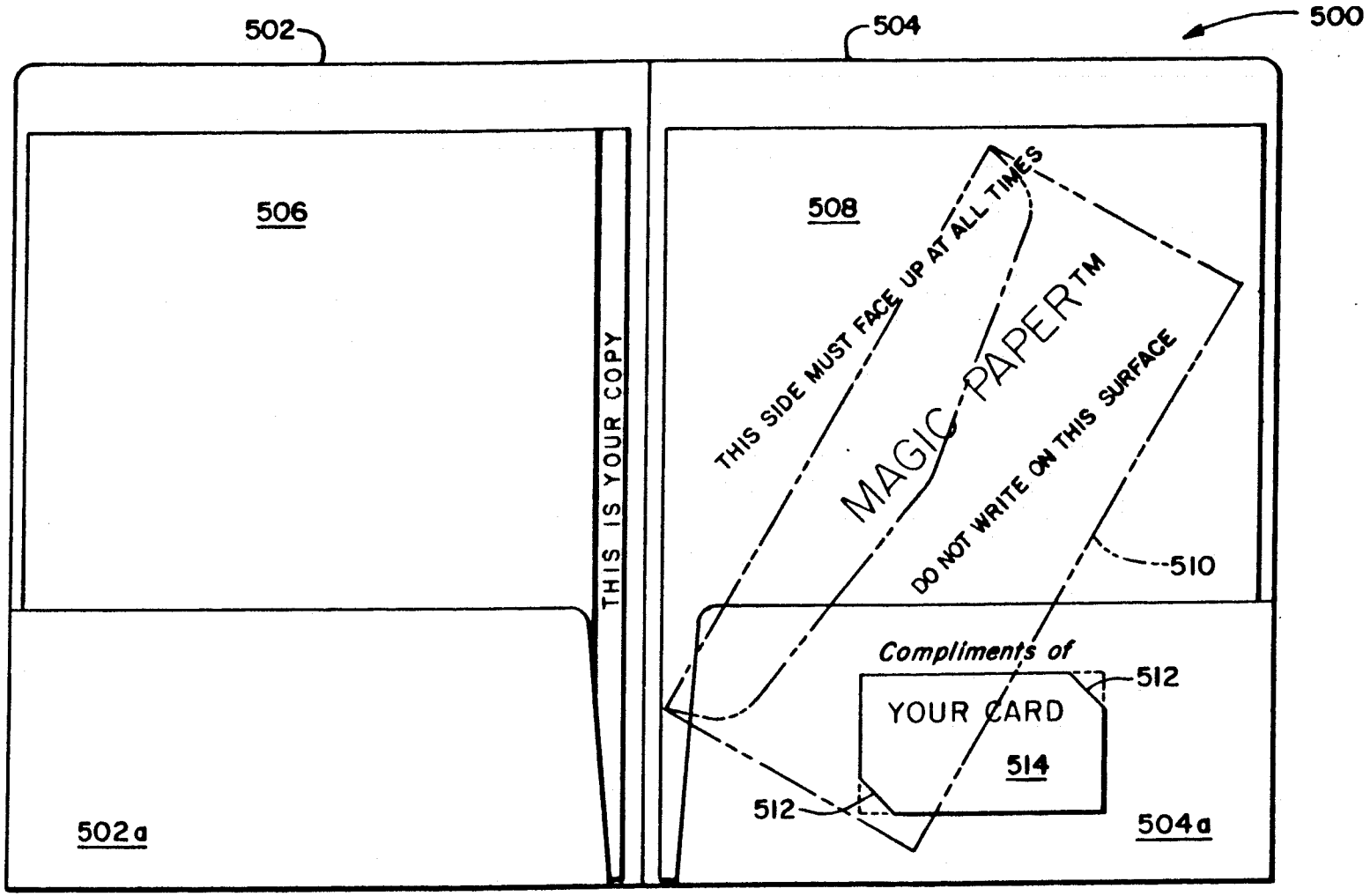
FIG. 5 is a plan view of a portfolio for containing a stationary articles manufactured according to the present

FIG. 5 shows a presentation folder 500 having a front cover 502 and a back cover 504. Each of the front and back covers is provided with a flap **502*a* and 504*a*, respectively, for holding stationery articles. In this example, the front cover holds a stationery article 506, such as the several of the folded panels 416 and 418 of FIG. 4A, and the back cover holds a stationery article 508 such as the intermediate transfer sheet 460 of FIG. 4A. Additionally, envelopes 510 are suitably stored in the back cover with the stationery articles 508. Additionally, the back flap 504*a* is provided with two spaced-apart slits 512 for holding another stationery article, such as a business card 514. The presentation folder 500 is useful for the form of FIG. 4A**, as well as for the form disclosed in U.S. patent application Ser. No. 484,686 (plain paper original, CF-coated copy), or for other form configurations disclosed in this or the parent cases.

As noted above ("Group 1 Improvements"), the equivalent weights of the original and copy panels can be made equal.

Also, as noted above ("Group 2 Improvements"), the copy panel can be larger (wider) than the original panel.

Also, as noted below ("Group 4 Improvements"), the original and copy panels can be produced as separate sheets, to be joined later into a single "virtual" sheet, or can be produced as a laminated article.

Group 4 Improvements

Joining Techniques

As disclosed in copending U.S. patent application Ser. No. 436,189, the form (e.g., the form 110 of FIG. 1A) can be provided as a single sheet of paper, or as two separate sheets (panels) in a "set").

According to the present invention, two separate panels are produced, for example one having a CB coating on both sides and forming the original panel, the other having a CF coating on both sides and forming the copy panel. The original and copy panels are joined at their inner edges using a variety of techniques disclosed herein to form a "virtual" single sheet. In this manner, paper stocks for the original and copy panels can be produced separately, thereby simplifying manufacture thereof, especially for mill stock.

It should be noted that the original panel can be uncoated, as described in the aforementioned U.S. patent application Ser. No. 484,686, in which case it would be joined to a CF-coated copy panel.

It should also be noted that the original panel can be CF-coated, as described above (Group 3 Improvements).

FIGS. 3A–3H show various techniques of joining individual original and copy panels 316 and 318 into a single, "virtual" sheet 310 having a front surface 312 and a back surface 314. This technique would be especially useful for manufacturers who lack the capability of coating each side of the sheet (e.g., the sheet 110 of FIG. 1A) with both carbonless CB and CF coatings, in that a CB-coated original panel can be joined to a CF coated copy panel. This is relevant whether the panels are substantially fully coated (as shown in FIGS. 1A–1C, and as disclosed in the aforementioned U.S. patent application Ser. No. 334,183), or have coatings applied only to specific areas (as disclosed in the aforementioned copending U.S. patent applications Ser. Nos.

436,189 and 494,565), or in the case of a non-coated original panel and CF-coated copy panel (as disclosed in the aforementioned U.S. patent application Ser. No. 484,686). Throughout FIGS. 3A-3H, an original panel and a copy panel are joined at or near what will ultimately be the fold line (e.g., the perforated fold line 120 of FIG. 1A) of the virtual sheet.

Figure 3A:
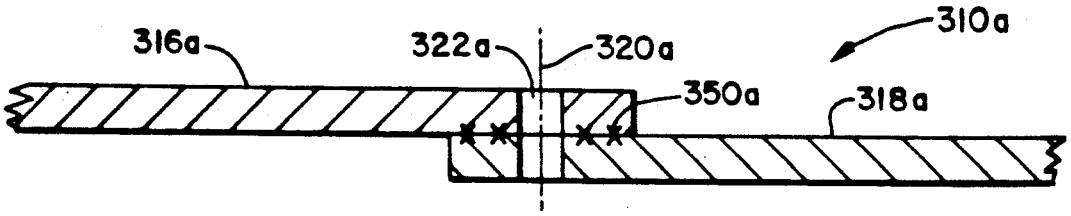
FIG. 3A is a cross-sectional view of a self-replicating duplex form, showing an embodiment of a technique for joining two panels into a "virtual" sheet.

FIG. 3A shows a first technique for joining an original panel 316*a* and a copy panel 318*a* into a single, virtual sheet 310*a*. In this embodiment, inner edges of the original and copy panels 316*a* and 318*a*, respectively, are simply overlapped, for instance by one-quarter inch, at what will ultimately be the fold line 320*a* (corresponding to the fold line 120 of FIG. 1A), and are glued with together with an adhesive 350*a*. A line of perforations 322*a* (corresponding to the perforations 122 of FIG. 1A) are provided through the overlapping inner edges of the original and copy panels, at the fold line 320*a*.

Figure 3B:
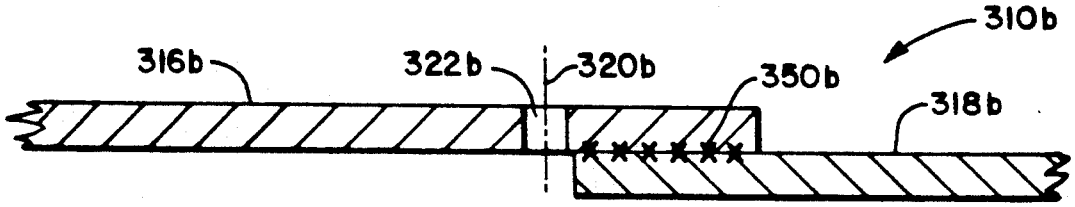
FIG. 3B is a cross-sectional view of a self-replicating duplex form, showing an alternate embodiment of a technique for joining two panels into a "virtual" sheet.

FIG. 3B shows an alternate technique for joining the original and the copy panels, 316*b* and 318*b*, into a single virtual sheet 310*b*. In this embodiment, again the inner edges of the original and copy panels 316*b* and 318*b*, respectively, are overlapped, for instance by one-quarter inch, near what will ultimately be the fold line 320*b* (corresponding to the fold line 120 of FIG. 1A), and are glued with together with an adhesive 350*b*. A line of perforations 322*b* (corresponding to the perforations 122 of FIG. 1A) is provided through the inner edge of the original panel, off to one side of the fold line 320*b*, more particularly, near the inner edge of the original panel 316*b*, adjacent the overlap. In this manner, the overlapping inner edges of the original and copy panels are separated from the original panel, and are "carried" with the copy panel.

Figure 3C:
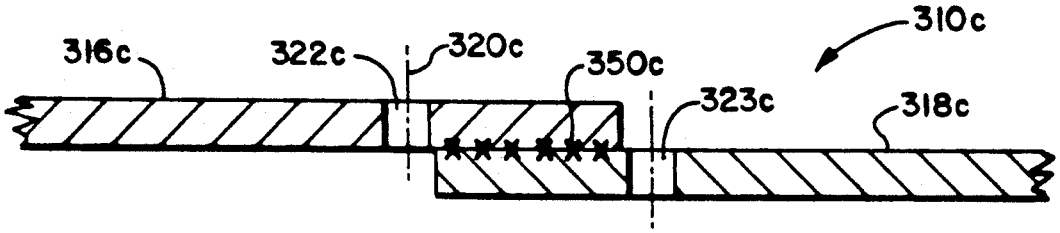
FIG. 3C is a cross-sectional view of a self-replicating duplex form, showing an alternate embodiment of a technique for joining two panels into a "virtual" sheet.

FIG. 3C shows an alternate technique for joining the original and the copy panels, 316*c* and 318*c*, into a single virtual sheet 310*c*. In this embodiment, again the inner edges of the original and copy panels 316*c* and 318*c*, respectively, are overlapped, for instance by one-quarter inch, at what will ultimately be the fold line 320*c* (corresponding to the fold line 120 of FIG. 1A), and are glued with together with an adhesive 350*c*. Two lines of perforations 322*c* and 323*c* are provided through the inner edges of the original and copy panels, off to either side of the fold line 320*c*, more particularly, near the inner edges of the original and copy panels, adjacent the overlap. In this manner, the overlapping inner edges of the original and copy panels may ultimately be separated from both the original and copy panels, and may be discarded as waste.

Figure 3D:
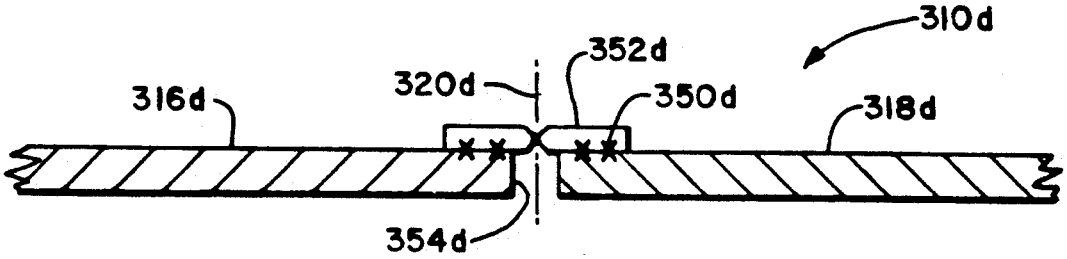
FIG. 3D is a cross-sectional view of a self-replicating duplex form, showing an alternate embodiment of a technique for joining two panels into a "virtual" sheet.

FIG. 3D shows an alternate technique for joining the original and the copy panels, 316*d* and 318*d*, into a single virtual sheet 310*d*. In this embodiment, the inner edges of the original and copy panels 316*d* and 318*d*, respectively, are abutted, or nearly abutted, there being a small gap 354*d* (0.0–0.125 inches) therebetween, at what will ultimately be the fold line 320*d* (corresponding to the fold line 120 of FIG. 1A). A narrow (e.g., one-eighth to one-half inch wide) tape 352*d* is laid along the fold line 320*d*, "bridging" the gap between the inner edges of the original and copy panels, and is secured to the inner edges of the original and copy panels with an adhesive 350*d*. As shown, the tape is "necked down" in thickness along the fold line 320*d*, to form a "living hinge" to facilitate folding the form (as discussed hereinabove) and to facilitate separating the original from the copy panel (after completely filling in the variable information on the form) along the fold line 320*d*. The tape 352*d* may be a paper or plastic tape, and in either case should be very thin so that it does not contribute significantly to the thickness of the sheet 310*d*.

Figure 3E:
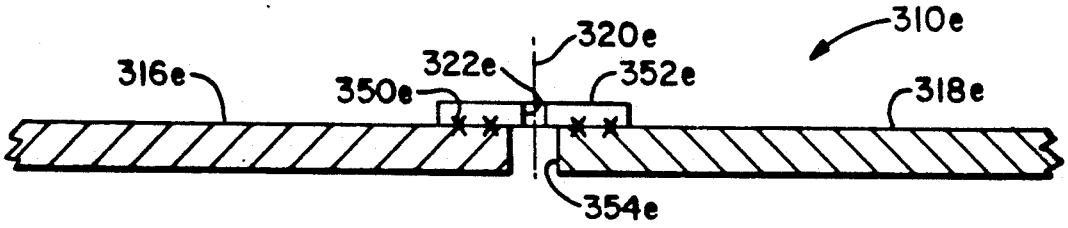
FIG. 3E is a cross-sectional view of a self-replicating duplex form, showing an alternate embodiment of a technique for joining two panels into a "virtual" sheet.

FIG. 3E shows an alternate technique for joining the original and the copy panels, 316*e* and 318*e*, into a single virtual sheet 310*e*. In this embodiment, again the inner edges of the original and copy panels 316*e* and 318*e*, respectively, are abutted, or nearly abutted, there being a small gap (0.0–0.125 inches) therebetween, at what will ultimately be the fold line 320*e* (corresponding to the fold line 120 of FIG. 1A). Again, a narrow (one-eighth to one-quarter inch wide) tape 352*e* is laid along the fold line 320*e*, "bridging" the gap 354*e* between the inner edges of the original and copy panels, and is secured to the inner edges of the original and copy panels with an adhesive 350*e*. As shown, the tape is provided with perforations 322*e* (corresponding to the perforations 122 of FIG. 1A) along the fold line 320*e*, to form a "living hinge" to facilitate folding the form (as discussed hereinabove) and to facilitate separating the original from the copy panel (after completely filling in the variable information on the form) along the fold line 320*e*. The tape 352*e* may be a paper or plastic tape, and in either case should be very thin so that it does not contribute significantly to the thickness of the sheet 310*e*.

Figure 3F:
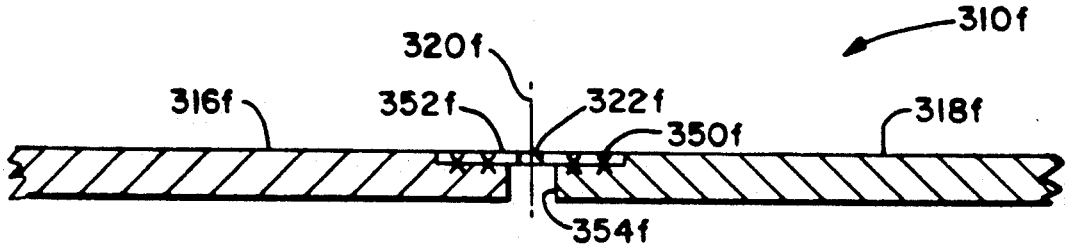
FIG. 3F is a cross-sectional view of the form of FIG. 2D.

FIG. 3F shows an alternate technique for joining the original and the copy panels, 316*f* and 318*f*, into a single virtual sheet 310*f*. In this embodiment, again the inner edges of the original and copy panels 316*f* and 318*f*, respectively, are abutted, or nearly abutted, there being a small gap 354*f* (0.0–0.125 inches) therebetween, at what will ultimately be the fold line 320*f* (corresponding to the fold line 120 of FIG. 1A). Again, a narrow (one-eighth to one-quarter inch wide) tape 352*f* is laid along the fold line 320*f*, "bridging" the gap between the inner edges of the original and copy panels, and is secured to the inner edges of the original and copy panels with an adhesive 350*f*. As shown, the tape is provided with perforations 322*f* (corresponding to the perforations 122 of FIG. 1A) along the fold line 320*f*, to form a "living hinge" to facilitate folding the form (as discussed hereinabove) and to facilitate separating the original from the copy panel (after completely filling in the variable information on the form) along the fold line 320*e*. The tape 352*f* may be a paper or plastic tape, and in either case should be very thin so that it does not contribute significantly to the thickness of the sheet 310*f*. As illustrated in FIG. 3F, the tape 352*f* is extremely thin, such as on the order of 0.1–0.5 mil, and is preferably pressed into the structure of the original and copy panels so that it does not add to their thickness at all. A suitable tape for this application is a mylar reinforcement tape available from Hammermill Papers (Flat-Stak TM).

Figure 3G:
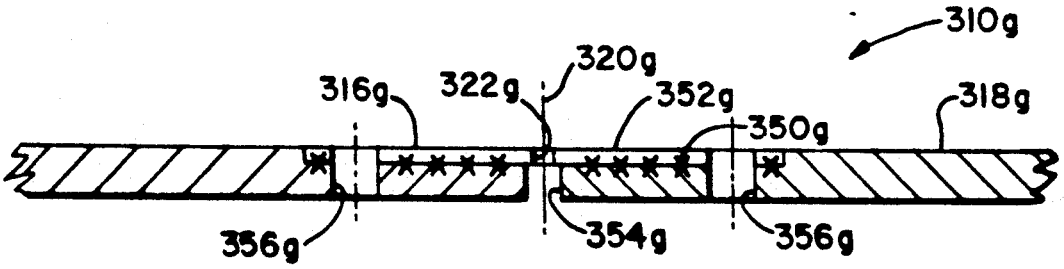
FIG. 3G is a cross-sectional view of a self-replicating duplex form, folded one way, showing an alternate embodiment of a technique for joining panels into a "virtual" sheet.

FIG. 3G shows a technique for joining the original and copy panels 316*g* and 318*g* into a single virtual sheet 310, and is similar in many respects to the technique discussed with respect to FIG. 3F. In this case, however, the tape 352*g* is wider (e.g., one-inch wide), and is provided with holes 356*g* for locating the original and/or copy panels in a three-ring binder, or the like. To this end, holes 356*g* in the copy panel 318*g* are provided through an outer portion of the tape 352*g* as well as through the copy panel 318*g*, at an appropriate distance from the fold line 320*g* that the copy panel 318*g* can be mounted in a binder (not shown), or in a file folder with two-prong fasteners (not shown). Similarly, holes 356g in the original panel 316g are provided through an outer portion of the tape 352g as well as through the original panel 316g, at an appropriate distance from the fold line 320g that the original panel 316g can be mounted in a binder or file folder. Referring to FIGS. 1A and 1B, it is seen that the "left" edges of "Sides 1" of both the original and copy panels are disposed at the fold line. The holes 356g are preferably formed in the tape and the original with the form already folded (i.e., after pre-printing and after filling out). This technique is especially appropriate for retaining the original and/or copy panels in a three-ring binder. Should it be desired that only the copy panel is punched with holes 356g for retention in a binder or the like, the holes 356g would need to be formed with the form unfolded. Also, by providing the wider tape configuration shown in FIG. 3G, without the holes 356g already punched therein, this provides the end user with the option of punching holes as desired, through the tape which will act as a reinforcement for the panel in a binder. The reinforcement feature is especially important, for instance, in the case of a lightweight panel, such as a 10–12# copy panel.

Figure 3H:
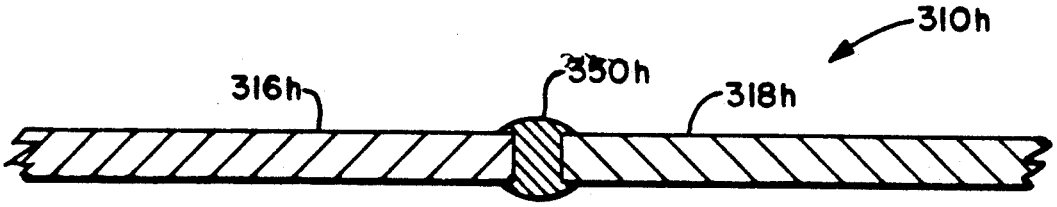
FIG. 3H is a cross-sectional view of the self-replicating duplex form of FIG. 3G, folded another way.

FIG. 3H shows an alternate technique for joining the original and the copy panels, 316h and 318h, into a single virtual sheet 310h. In this embodiment, again the inner edges of the original and copy panels 316h and 318h, respectively, are abutted, or nearly abutted, there being a small gap (0.0–0.125 inches) therebetween, at what will ultimately be the fold line 320h (corresponding to the fold line 120 of FIG. 1A). A narrow "bead" of adhesive 350h is laid along the fold line 320h, "bridging" the gap between the inner edges of the original and copy panels. As shown, the bead 350h does not need to be provided with perforations, as it will act as a "living hinge" to facilitate folding the form (as discussed hereinabove) and to facilitate separating the original from the copy panel (after completely filling in the variable information on the form) along the fold line 320h. As with the tape embodiments, the adhesive should be very thin so that it does not add significantly to the thickness of the sheet 310h. A suitable adhesive for this application is any of a number of "padding" adhesives such as are commonly used by forms manufacturers.

As noted above ("Group 1 Improvements"), the equivalent weights of the original and copy panels can be made equal. More significantly, however, the "base" paper stocks for the original and copy panels, and their total coated thicknesses, can be completely dissimilar. For instance, in a case where it is desirable to have an uncoated, high rag content or acid-free original panel, such a panel can be joined with a CF-coated copy panel. (An embodiment with an uncoated original panel, a CF-coated copy panel and a CB-coated intermediate transfer panel is disclosed in the aforementioned U.S. patent application Ser. No. 484,686.)

Also, as noted above ("Group 2 Improvements"), the copy panel can be advantageously larger than the original panel.

Also, as noted above ("Group 3 Improvements"), an additional intermediate transfer sheet can be provided to eliminate the need for having carbonless CB coatings on the original panel.

Laminating Techniques

It was discussed, hereinabove (Group 4—Joining Techniques) how two panels of paper can be joined into a single "virtual" sheet. Such a technique is useful, for instance, for manufacturers who lack capability of producing a single sheet with the various coating configurations discussed herein and in the copending patent applications.

FIGS. 6A–6J show various techniques for manufacturing a self-replicating duplex form (or stationary article, see e.g. Group 3 Improvements) as a laminated structure. The views are "exploded", and cross-section lines are omitted from the paper stock. CB coatings are shown as circles, and CF coatings are shown as cross-section lines. Throughout the figures, individual laminates are laid together to form various original and copy panels, in a single "virtual" sheet. Where trim lines ("A" and "B" are shown, the original panel 616x extends from the trim line "A" to the fold line 620x, and the copy panel 618x extends from the fold line to the trim line "B". ("x" is the figure suffix "a" through "j".) Perforations are designated 622a. As will be evident, while trim lines are shown, the paper need no be trimmed.

In the case of an original panel coated on both sides with carbonless CB and a copy panel coated on both sides with carbonless CF, in a "true" single sheet configuration, as disclosed for instance in copending U.S. Pat. No. 5,127,879, it would be necessary to coat both sides of the sheet with both CB and CF coatings. This would require manufacturing capability which may be beyond the reach of some carbonless paper manufacturers. The techniques described below make producing forms with the various coating arrangements discussed herein and hereinbefore in the copending U.S. patent applications available to virtually every manufacturer or print shop.

Figure 6A:
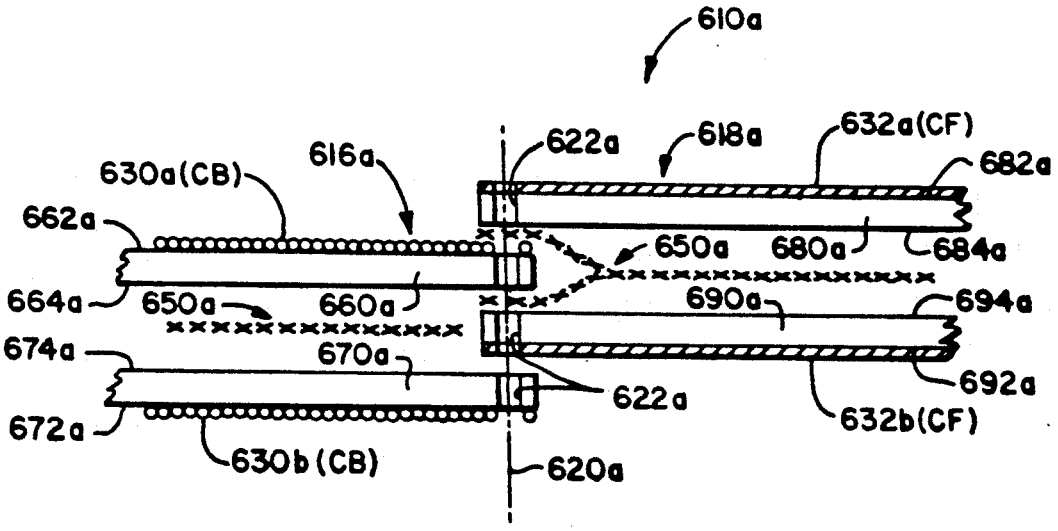
FIG. 6A is a cross-sectional view of a self-replicating duplex form, showing an embodiment of a technique for laminating two panels into a "virtual" sheet.

FIG. 6A shows (exploded view) a technique for manufacturing separate panels of readily-available carbonless paper stock into a single "virtual" sheet 610a. In this case, the original panel 616a is formed to two panels ("laminates") of carbonless CB paper stock (each coated on only one side with carbonless CB) and two panels of carbonless CF paper stock (each coated on only one side with carbonless CF), as follows.

A panel (laminate) 660a of carbonless CB paper stock has a coating 630a of carbonless CB on one of its surfaces 662a and is uncoated (i.e., does not have a carbonless coating) on its opposite surface 664a. Similarly, a panel (laminate) 670a of carbonless CB paper stock is coated on one of its surfaces 672a with carbonless CB 630b, and its opposite surface 674a is not coated. A layer of adhesive 650a is applied between the uncoated surfaces 664a and 674a of the panels 660a and 670a, respectively, to form a laminated structure for the original panel 616a which is coated on both sides with carbonless CB.

A panel (laminate) 680a of carbonless CF paper stock has a coating 632a of carbonless CF on one of its surfaces 682a and is uncoated (i.e., does not have a carbonless coating) on its opposite surface 684a. Similarly, a panel (laminate) 690a of carbonless CF paper stock is coated on one of its surfaces 692a with carbonless CF 632b, and its opposite surface 694a is not coated. A layer of adhesive 650a is applied between the uncoated surfaces 684a and 694a of the panels 680a and 690a, respectively, to form a laminated structure for the copy panel 618a which is coated on both sides with carbonless CF.

As shown, the inner edges of the panels 660a, 670a, 680a and 690a can be interleaved and overlapped, in a manner similar to that shown with respect to FIG. 3A, and perforated with perforations 622a along a fold line 620*a* distinguishing the original panel 616*a* from the copy panel 618*a*.

Alternatively, the inner edges of the two CF panels 680*a* and 690*a* can be laminated and sandwiched between (not shown), rather than interleaved with (as shown) the two CB panels 660*a* and 670*a*. This would resemble the next configuration discussed with respect to FIG. 6B.

In the various laminating techniques disclosed wherein the inner edges of the original and copy panels are overlapped (e.g., FIGS. 6A, 6B, 6C, 6D and 6F), the fold line 620 and perforations 622 can advantageously be located off to one side of the overlapping inner edges of the original and copy panels, as shown in FIG. 3B, preferably towards the inner edge of the original panel.

Figure 6B:
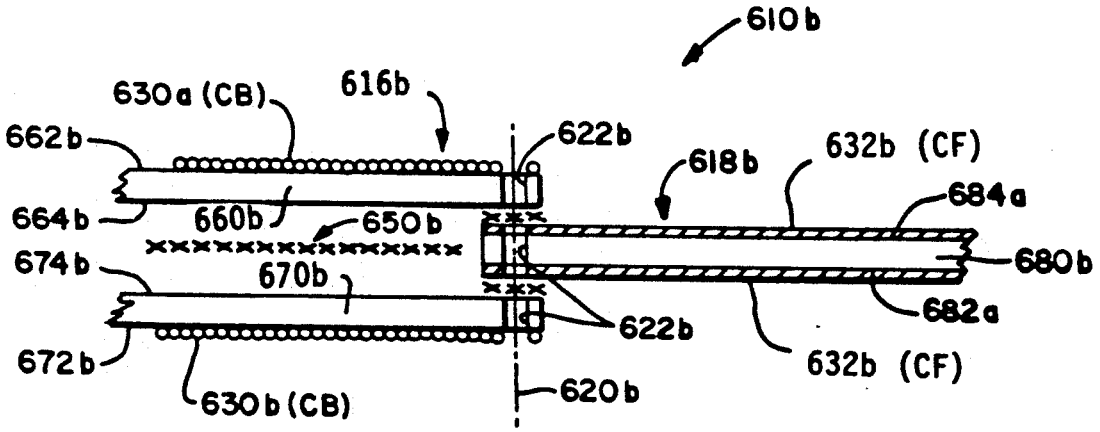
FIG. 6B is a cross-sectional view of a self-replicating duplex form, showing an alternate embodiment of a technique for laminating two panels into a "virtual" sheet.

FIG. 6B shows an alternate technique for forming a single "virtual" sheet having an original panel coated on both sides with carbonless CB and a copy panel coated on both sides with carbonless CF.

As in the previously described embodiment (FIG. 6A), the panel 660*b* of carbonless CB paper stock has a coating 630*a* of carbonless CB on one of its surfaces 662*b* and its opposite surface 664*b* is not CB-coated. A panel 670*b* of carbonless CB paper stock is coated on one of its surface 672*b* with carbonless CB 630*b*, and its opposite surface 674*b* is not CB-coated. A layer of adhesive 650*b* is applied between the uncoated surfaces 664*b* and 674*b* of the panels 660*b* and 670*b*, respectively, to form a laminated structure for the original panel 616*b* which is coated on both sides with carbonless CB.

Unlike the previously described embodiment (FIG. 6A), in this embodiment a single panel 680*b* of "CF C2S" (coated on both sides with carbonless CF) coated carbonless paper has a CF coating 632*b* on one of its surfaces 682*b* and has a CF coating 632*b* on its opposite surface 684*b*.

As in the previously described embodiment (FIG. 6A), the inner edge of the CF-coated copy panel 618*b* is sandwiched between the inner edges of the panels 660*b* and 670*b* forming the original panel 616*b*. The inner edges are appropriately perforated with perforations 622*b* along a fold line 620*b*.

Although not shown, a single panel coated with CB on both sides could be joined to two panels (or a folded single panel) coated with CF on one side. In such a case, the panel 680*b* would be CB coated (both sides) and the panels 660*b* and 670*b* would be CF-coated (one side).

Figure 6C:
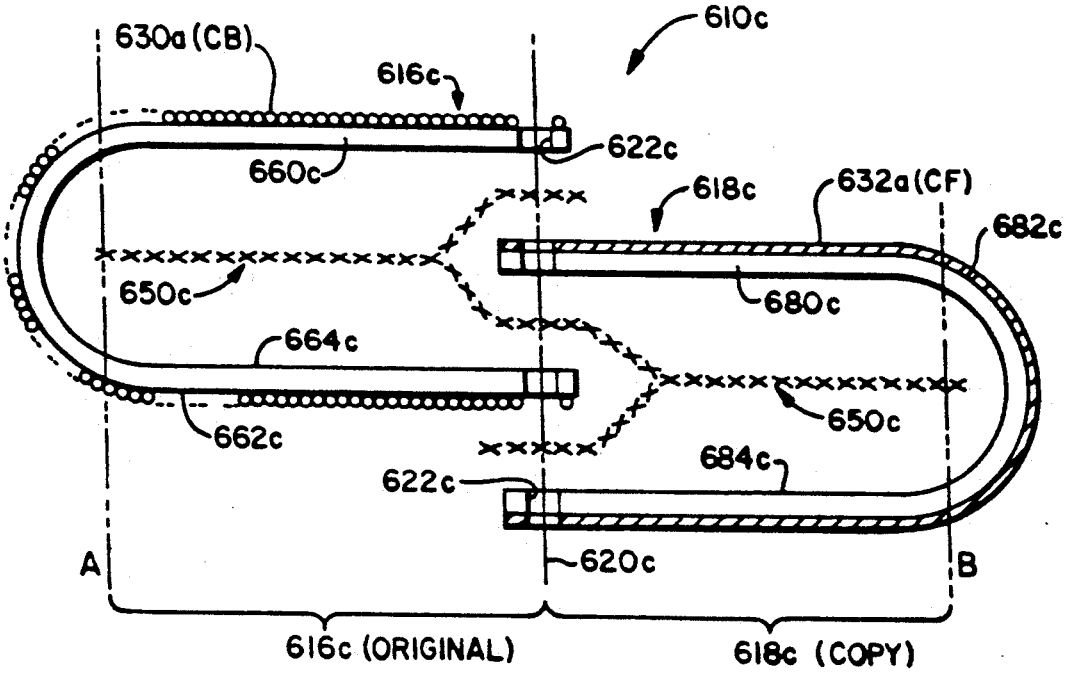
FIG. 6C is a cross-sectional view of a self-replicating duplex form, showing an embodiment of a technique for laminating two panels into a "virtual" sheet.

FIG. 6C illustrates a variation on the technique of FIG. 6A, but is also applicable to the technique of FIG. 6B. In this case, there is only one CB panel 660*c*, and it is folded upon itself so that its CB-coated surface 662*c* is exposed. Its uncoated surface 664*c* is glued with an adhesive 650*c* to form a laminated original panel 616*c* having a CB coating 630*a* on both its front and back surfaces. Although the folds are shown curved (with a relatively large radius), they are preferably ultimately creased, as shown in FIGS. 6C–6J. As indicated by the line "A", the actual fold of the CB panel 660*c* can be excised (trimmed) at the outer edge of the original panel 616*c*.

Similarly, in this embodiment there is only one CF panel 680*c*, and it is folded upon itself so that its CF-coated surface 682*c* is exposed, after lamination. Its uncoated surface 684*c* is glued with an adhesive 650*a* to form a laminated copy panel 618*c* having a CF coating 632*a* on both its front and back surfaces. As indicated by the line "B", the actual fold of the CF panel 680*c* can be excised (trimmed) to form the outer edge of the copy panel 618*c*.

In FIGS. 6C–6J trim lines "A" and "B" are shown. The original panel extends between the trim line "A" and the fold line (620*x*) and the copy panel extends between the fold line and the trim line "B". While the laminated article need not be trimmed (but preferably are trimmed), these trim lines aid in following the descriptions of the drawings.

The technique of FIG. 6C, namely laminating a panel upon itself, can be applied to only one of the panels, for instance to form the original panel 616*b* of the embodiment of FIG. 6B (which uses a single thickness CF C2S copy panel 618*b*, and therefore need not be a laminated structure of two CF panels).

Figure 6D:
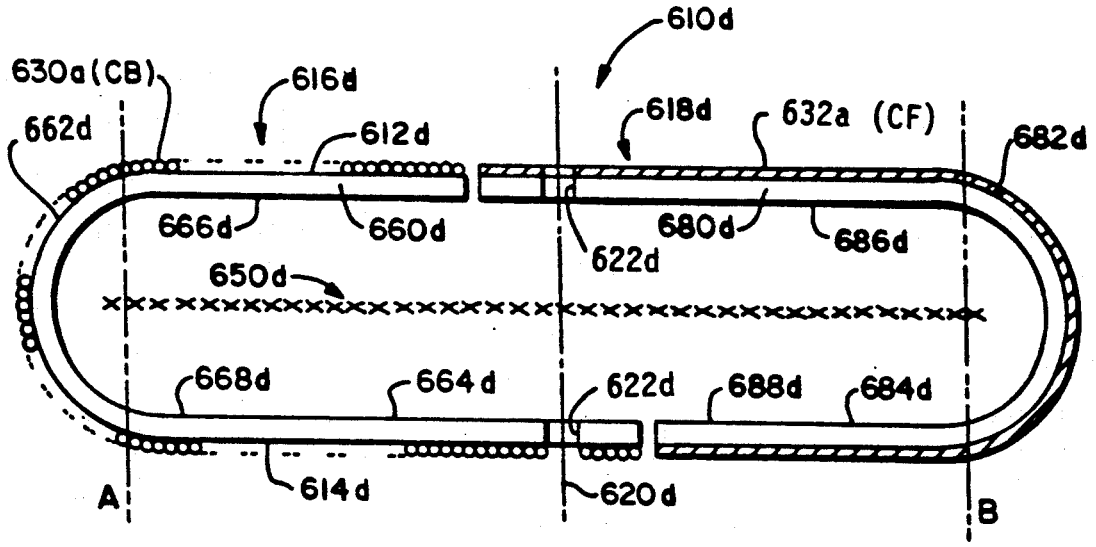
FIG. 6D is a cross-sectional view of a self-replicating duplex form, showing an alternate embodiment of a technique for laminating two panels into a "virtual" sheet.

FIG. 6D shows a variation on the technique of FIG. 6C, dealing mainly with the way in which the inner edges of the original and copy panels are joined together. In this case, by way of example, a single CB panel 660*d* is folded and laminated so that its CB-coated surface 662*d* is exposed, forming both sides of the original panel 616*d*, and a single CF-coated panel 680*d* is folded and laminates so that its CF-surface 682*d* is exposed, forming both sides of the copy panel 618*d*. The uncoated surfaces 664*d* and 684*d* of the CB and CF panels 660*d* and 680*d*, respectively, are glued with a laminating adhesive 650*d*. The resulting form has a front surface 612*d* and a back surface 614*d*. A portion 666*d* of the panel 660*d* forming the front surface of the original panel extends nearly to the fold line 620*a*, and a portion 668*d* of the panel 660*d* forming the back surface of the original panel extends slightly past the fold line. Conversely, a portion 686*d* of the panel 680*d* forming the front surface of the copy panel 618*d* extends slightly past the fold line, overlaps the inner edge of the portion 668*d*, and abuts the inner edge of the portion 666*d*. A portion 688*d* of the panel 680*d* forming the back surface of the copy panel extends nearly to the fold line and abuts the inner edge of the portion 668*d*. In contrast to the embodiments of FIGS. 6A, 6B and 6C, this configuration does not increase the thickness of the resultant form at the joint (fold line 620*d*). The overlap of portions 668*d* and 686*d* discussed above is readily reversed so that the portions 666*d* and 688*d* would extend slightly past the fold line and overlap each other.

Figure 6E:
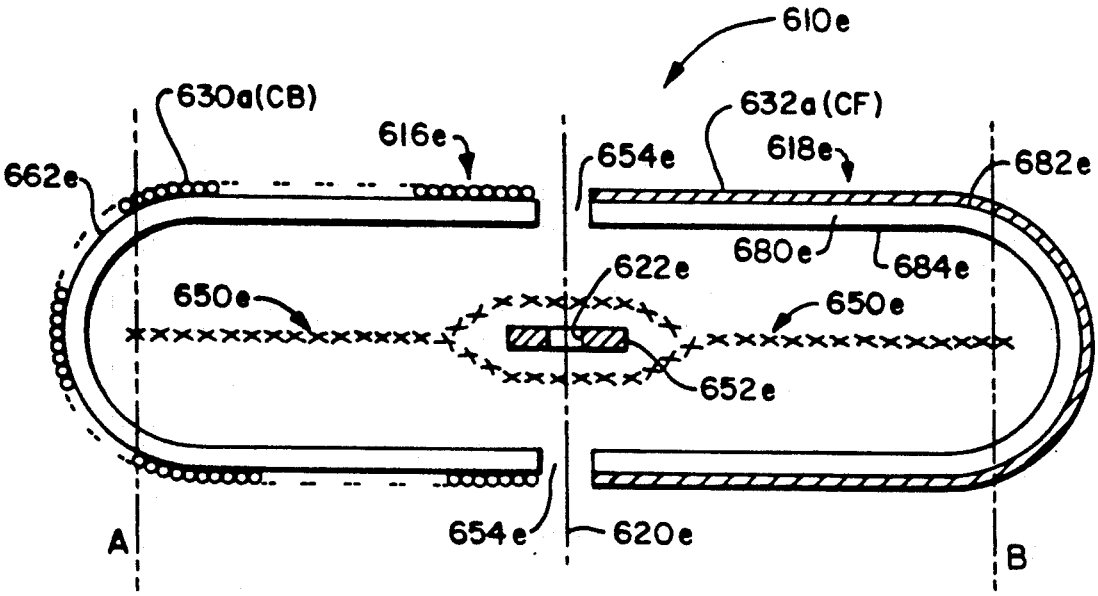
FIG. 6E is a cross-sectional view of a self-replicating duplex form, showing an alternate embodiment of a technique for laminating two panels into a "virtual" sheet.

FIG. 6E shows an alternate technique for producing a virtual single sheet form 610*e* as a laminated structure. As in the technique discussed with respect to FIG. 6C, a single CB panel 660*e* is folded and laminated so that its CB-coated surface 662*e* is exposed, forming both sides of the original panel 616*e*, and a single CF-coated panel 680*e* is folded and laminates so that its CF-surface 682*e* is exposed, forming both sides of the copy panel 618*e*. In a manner similar to that shown in FIG. 3E, a narrow tape 652*e* bridges the gaps 654*e* between the inner edges of the original and copy panels. However, in this case, the tape 652*e* is located within the interior of the form, between the laminates of the original and copy panels. The uncoated surfaces 662*e* and 682*e* of the panels 660*e* and 680*e*, respectively, are laminated with an adhesive 650*e*.

The gap can be of "zero" dimension, resulting in a perfect "butt" joint between the inner edges of the original and copy panels, or it can be small, such as on the order of a few thousandths or tens of thousandths of an inch to facilitate folding of the original panel one way for entering (variable) information on one side thereof and the other way for entering information on the other side thereof. In either case (zero or finite gap), the inner edges of the original and copy panels can be maintained perfectly parallel by first overlapping them then trimming them (not shown).

Figure 6F:
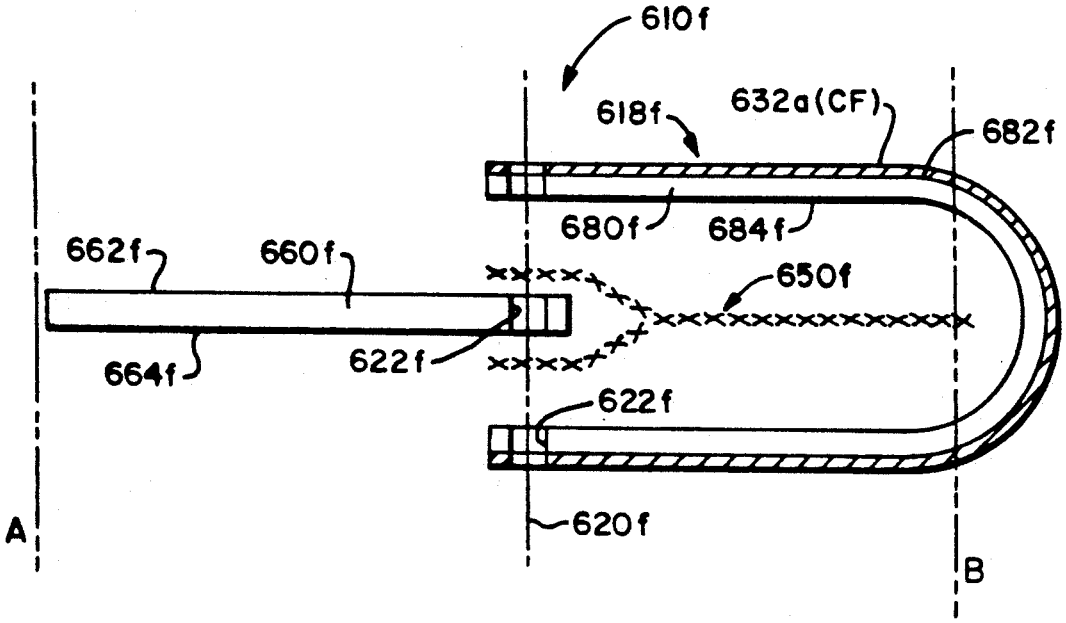
FIG. 6F is a cross-sectional view of a self-replicating duplex form, showing an embodiment of a technique for laminating two panels into a "virtual" sheet.

FIG. 6F shows an alternate technique for producing a form of laminated construction, similar in many respects to the technique discussed with respect to FIG. 6B. In this case, a plain paper panel 660*f* (not carbonless coated and not of laminated construction) forming the original panel 616*f* is joined to a CF panel 680*f* folded to form the copy panel 618*f*. The panel 680*f* is formed of CF-coated paper stock, and is folded so that its CF surface 682*f* is exposed to form the front and back surfaces of the copy panel. This configuration relates, but is not limited to the form disclosed in copending U.S. patent application Ser. No. 484,686 wherein the original panel is not coated, the copy panel is coated on both sides with CF, and an intermediate CB-coated transfer panel (not shown) effects image transfer from the original panel to the copy panel. The uncoated surfaces 662*f* and 682*f* are laminated with an adhesive 650*f*.

Figure 6G:
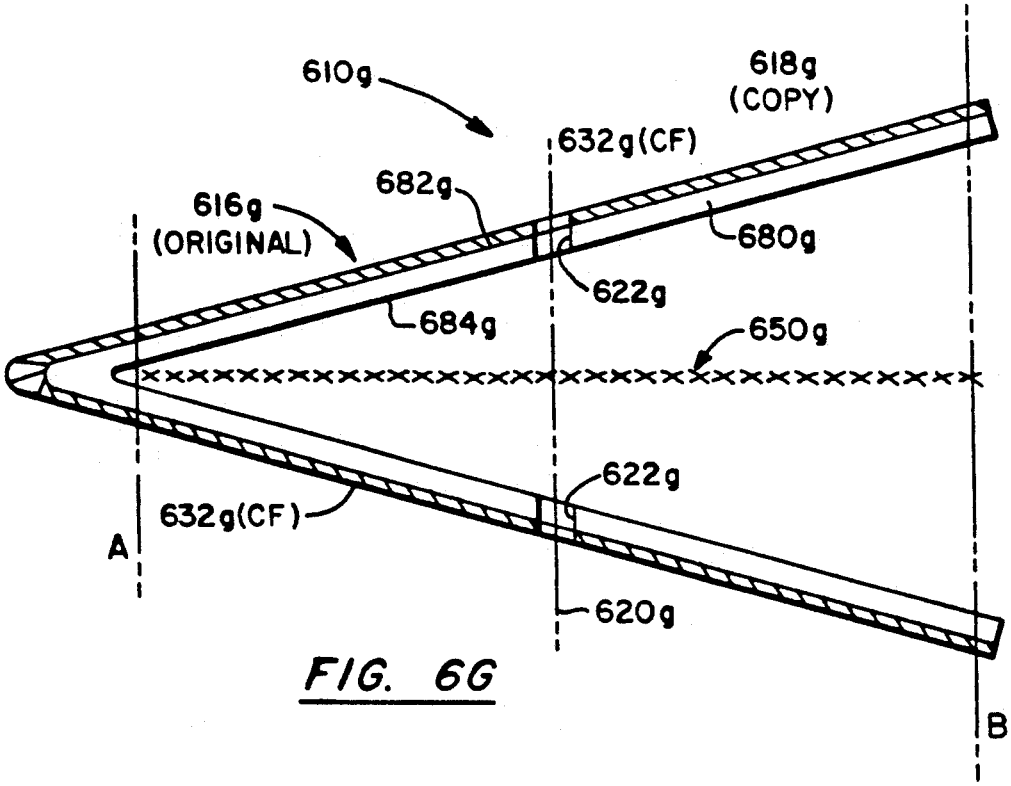
FIG. 6G is a cross-sectional view of a self-replicating duplex form, showing an alternate embodiment of a technique for laminating two panels into a "virtual" sheet.

FIG. 6G shows an alternate technique for producing a form of laminated construction, similar in many respects to the technique discussed for forming the laminated copy panel (680*c*) of FIG. 6C. In this case, a single CF-coated panel 680*g* is folded to expose its CF-coated surface 682*g* and conceal its uncoated surface 684*g*. An original panel 616*g* is thus formed to one side of the fold line 620*g*, and a copy panel 618*g* is formed to the other side of the fold line. Both original and copy panels have CF coating 632*g* on both sides, as described with respect to the configuration of Group 3 (compare FIG. 4C). The uncoated surface 684*g* of the panel 680*g* is laminated with an adhesive 650*g*.

Figure 6H:
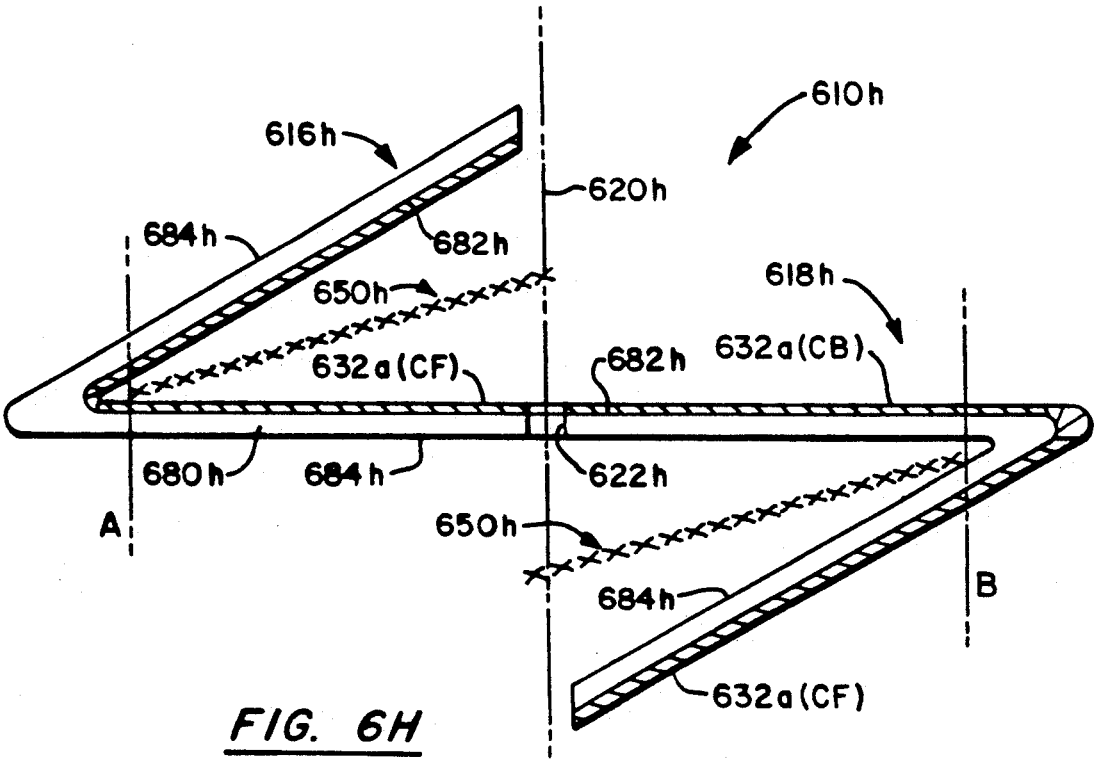
FIG. 6H is a cross-sectional view of a self-replicating duplex form, showing an alternate embodiment of a technique for laminating two panels into a "virtual" sheet.

FIG. 6H shows a laminating technique for another coating configuration. This configuration relates, but is not limited to the form disclosed in copending U.S. patent application Ser. No. 484,686 wherein the original panel is not coated, the copy panel is coated on both sides with CF, and an intermediate CB-coated transfer panel (not shown) effects image transfer from the original panel to the copy panel. In this case, a sheet of paper stock 680*h* having a CF-coating 632*a* on one side 682*h* thereof (and no carbonless coating on the opposite side 684*h*) is folded in a "Z" configuration so that the ultimately formed original panel 616*h* will be uncoated (684*h*) and the ultimately formed copy panel 618*h* will have a CF coating 632*a* on both sides.

Figure 6I:
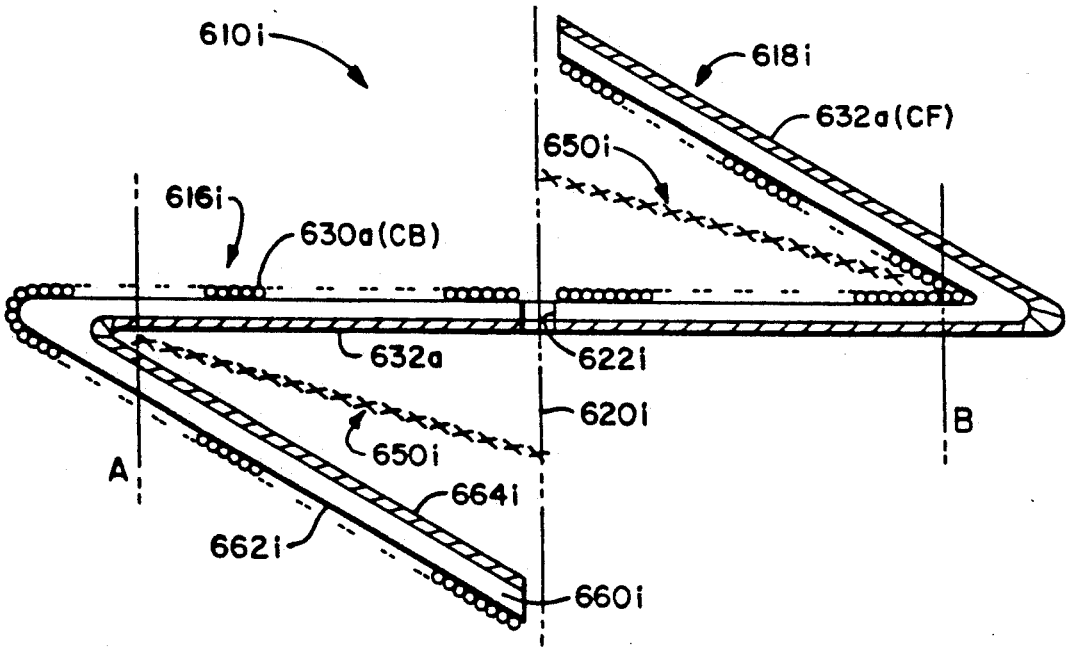
FIG. 6I is a cross-sectional view of a self-replicating duplex form, showing an embodiment of a technique for laminating two panels into a "virtual" sheet.

FIG. 6I shows a laminated technique for producing a form having a CB C2S (both sides CB-coated) original panel 616*i* and a CF C2S (both sides coated) copy panel 618*i*. such as is disclosed in copending U.S. patent application Ser. No. 334,183 wherein the original panel is CB-coated on both sides and the copy panel is CF-coated on both sides. In this case, a single sheet of CFB (CF-coated front, CB-coated back) paper stock 660*i* is folded in a "Z" configuration so that a portion of the sheet 660*i* to one side of the fold line 620*i* is folded and glued CF-face 664*i* to CF-face so that the CB coating 630*a* is exposed (for entering information) on both sides of the original panel 616*i*, and so that a portion of the sheet 660*i* to the other side of the fold line is folded CB-face 662*i* to CB-face so that the CF coating 632*i* is exposed for reproducing information on both sides of the copy panel 618*i*.

Interestingly, as shown in FIG. 6I, due to the fact that each of the original and copy panels has two thicknesses of paper (laminate), two thicknesses of CB coating and two thicknesses of CF coating, they are inherently of equal thickness (equivalent weights), which has advantages as discussed hereinabove This is true for the laminating techniques of FIGS. 6G through 6J.

Figure 6J:
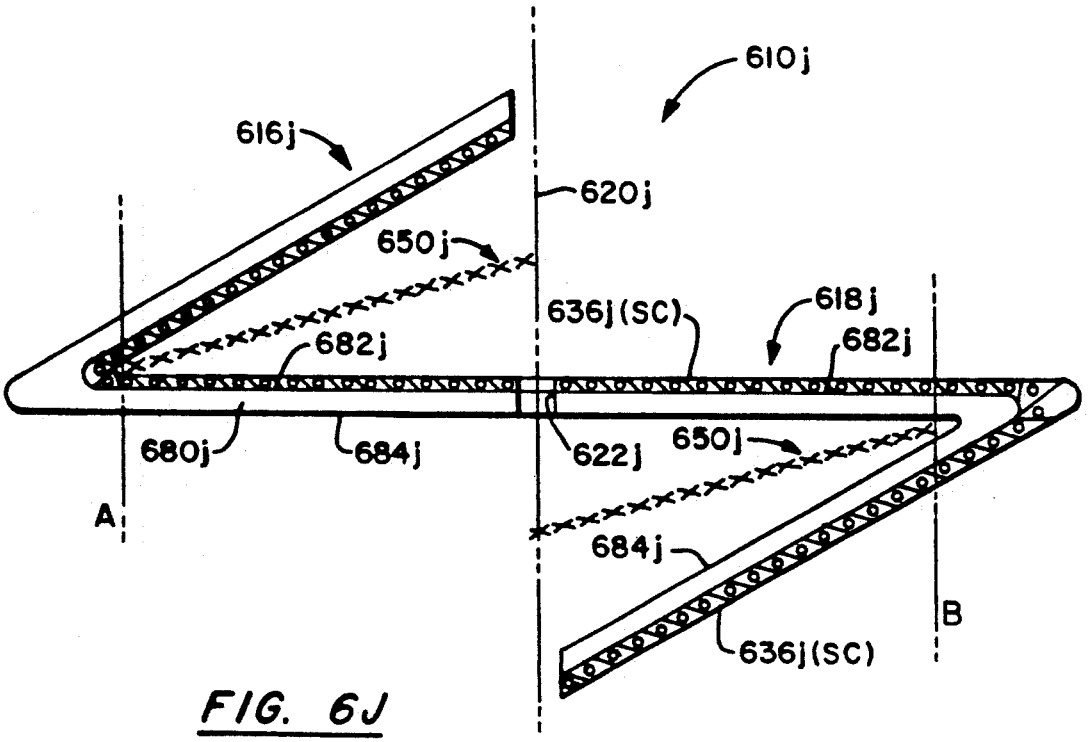
FIG. 6J is a cross-sectional view of a self-replicating duplex form, showing an alternate embodiment of a technique for laminating two panels into a "virtual" sheet.

FIG. 6J shows yet another laminating technique, again a "Z-fold" configuration, producing a plain paper (no carbonless coating) original panel 616*j* and a copy panel 618*j* having Self-Contained (SC) coating 636*j* on both sides, as disclosed in copending U.S. patent application Ser. No. 436,189 wherein the original panel is not carbonless coated, and the copy panel is coated with carbonless SC (Self-contained) on both sides. This type of construction is especially advantageous in that the SC-coated copy panel can be made sufficiently thick that the "wrong" side (i.e., the side that is not supposed to be reproducing, unless the form is folded an opposite way) does not reveal an image, for instance on the order of 36# (laminated), or greater (40# in the case of folding 20#) SC-stock. Folded as in FIG. 6I, a portion of the sheet 680*j* forming the original panel 616*j* is folded and glued 650*j*) SC-face 682*j* to SC-face, and a portion of the sheet 680*j* forming the copy panel 618*j* is folded plain (uncoated) face 684*j* to plain face (and glued 650*j*). In these "Z" configurations (FIGS. 6H, 6I, 6J), the outer edges of the sheet may be folded in just short of the fold line (620*x*), leaving a weak, single thickness area at the fold line for facilitating folding and separating (even without perforations 622*x*) the original from the copy panel.

The above-described laminating technique advantageously employ relatively thin (e.g., 10–12#) carbonless paper stock that is readily available from most manufactures. For the adhesive (650*x*), present adhesives used for stubbing and padding are suitably employed.

In this, as in all cases, the original and copy panels may ultimately be disposed one above the other with a horizontal fold line separating them. Generally, having the original and copy panels side-by-side with a vertical fold line yields a more "user-friendly" form orientation, and is very distinguishable from manifold forms.

In those embodiments where a panel is folded upon itself to expose a coating on one side of the panel for the front and back surfaces of the original or copy panels, fixed information can be pre-printed on the one surface ultimately exposed for writing. In this manner, duplex (two-sided) preprinted information can be provided by printing only one side of a sheet, in an intermediate (prior to laminating) step.

The laminating techniques disclosed herein may be advantageously combined with the coating techniques of Group 1, the larger copy panel techniques of Group 2, the coating configurations of Group 3, and the joining techniques of Group 4, above. Other folding and laminating arrangements are intended to be within the scope of the invention, as claimed.

CONCLUSION

Various improvements to the disclosures of the parent cases are disclosed, which make the self-replicating duplex form more "user friendly" and easier to manufacture.

What is claimed is:

1. Carbonless form for reproducing information entered on both sides of an original panel onto both sides of a copy panel, comprising:

an original panel having a front surface and a back surface, and coated with carbonless CB coating on its front and back surfaces;

a copy panel having a front surface and a back surface, and coated with carbonless CF coating on its front and back surfaces;

wherein:

the copy panel is larger than the original panel; and the copy panel is longer than the original panel, thereby forming an exposed marginal strip along the bottom of the copy panel when the original and copy panels are aligned for entering information.

2. Carbonless form for reproducing information entered on both sides of an original panel onto both sides of a copy panel; comprising:

an original panel having a front surface and a back surface, and coated with carbonless CB coating on its front and back surfaces;

a copy panel having a front surface and a back surface, and coated with carbonless CF coating on its front and back surfaces;

wherein:

the copy panel is larger than the original panel; and the copy panel is wider than the original panel, thereby forming an exposed marginal strip along an outer edge of the copy panel when the original and copy panels are aligned for entering information.

3. Carbonless form for reproducing information entered on both sides of an original panel onto both sides of a copy panel, comprising:

a single sheet of paper having a front surface and a back surface and two portions, one portion designated an "original" panel and the other portion designated a "copy" panel, each of the original and copy panels having front and back surfaces;

carbonless CB coating on the front and back surfaces of the original panel;

carbonless CF coating on the front and back surfaces of the copy panel;

wherein:

the copy panel is larger than the original panel; and a marginal strip along an outer edge of the copy panel is exposed when the original and copy panels are aligned for entering information.

4. Carbonless form, according to claim 3, wherein:

the exposed marginal strip protrudes beyond an outer edge of the original panel when the form is folded for entering information on the original panel.

5. Carbonless form, according to claim 3, wherein:

the copy panel is wider than the original panel.

6. Carbonless form, according to claim 3, wherein:

the copy panel is longer than the original panel.

7. Carbonless form, according to claim 3, further comprising:

a registration line printed along the edge of the copy panel in registration with the edge of the original panel.

8. Carbonless form, according to claim 3, further comprising:

a line of perforations formed along the edge of the copy panel in registration with the edge of the original panel.

9. Carbonless form, according to claim 3, further comprising:

instructions printed along the marginal strip.

10. Carbonless form, according to claim 3, further comprising:

legends pre-printed in a random repeat pattern across the front and back surfaces of the copy panel in an area generally exclusive of an area defined by the marginal strip.

11. Carbonless form, according to claim 3, further comprising:

carbonless CB coating covering substantially the entire front and back surfaces of the original panel; and carbonless CF coating covering substantially the entire front and back surfaces of the copy panel.

12. Carbonless form, according to claim 3, further comprising:

carbonless CB coating covering only selected areas on the front and back surfaces of the original panel; and carbonless CF coating covering only selected areas on the front and back surfaces of the copy panel.

13. Carbonless form, according to claim 3, further comprising:

a line of perforations disposed between the original and the copy panels.

14. Carbonless form, according to claim 3, wherein:

the equivalent weights of the CB coating on the original panel and the CF coating on the copy panel are equal.

* * * * *